US010696050B2

(12) United States Patent
Takada et al.

(10) Patent No.: US 10,696,050 B2
(45) Date of Patent: Jun. 30, 2020

(54) INK JET PRINTING APPARATUS AND INK JET PRINTING METHOD

(71) Applicant: CANON KABUSHIKI KAISHA, Tokyo (JP)

(72) Inventors: Yoichi Takada, Yokohama (JP); Ryosuke Hirokawa, Kawasaki (JP); Mitsutoshi Noguchi, Kawaguchi (JP); Shingo Okushima, Kawasaki (JP); Toru Ohnishi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/020,015

(22) Filed: Jun. 27, 2018

(65) Prior Publication Data

US 2019/0009549 A1 Jan. 10, 2019

(30) Foreign Application Priority Data

Jul. 4, 2017 (JP) ..... 2017-131279

(51) Int. Cl.
*B41J 2/005* (2006.01)
*B41J 2/165* (2006.01)
(Continued)

(52) U.S. Cl.
CPC ..... *B41J 2/16505* (2013.01); *B41J 2/01* (2013.01); *B41J 2/1404* (2013.01);
(Continued)

(58) Field of Classification Search
USPC ..... 347/89, 103; 399/99
See application file for complete search history.

(56) References Cited

U.S. PATENT DOCUMENTS 5,481,284 A 1/1996 Kitahara et al.
5,818,485 A * 10/1998 Rezanka ..... B41J 2/175 347/89
(Continued)

FOREIGN PATENT DOCUMENTS

JP 2008-019286 A 1/2008
JP 2008-080655 A 4/2008

OTHER PUBLICATIONS

U.S. Appl. No. 16/020,078, Shingo Okushima Ryosuke Hirokawa Toru Ohnishi Yoichi Takada Mitsutoshi Noguchi Takuto Moriguchi, filed Jun. 27, 2018.
(Continued)

*Primary Examiner* — Lam S Nguyen
(74) *Attorney, Agent, or Firm* — Venable LLP

(57) ABSTRACT

An ink jet printing apparatus including: an image forming unit which forms an ink image containing an aqueous liquid component and a coloring material, including a reaction solution applying unit and an ink applying unit; and a liquid absorbing unit for absorbing at least a portion of a liquid component from the ink image by bringing a porous body into contact with the ink image, the liquid absorbing unit including a liquid absorbing member having the porous body, wherein the ink applying unit includes a liquid ejection head including a plurality of printing element substrates each having an element which generates energy that is utilized for discharging a liquid, a pressure chamber which has the element in the inside, and a plurality of ejection orifices which discharge a liquid, and the ink is circulated between the inside of the pressure chamber and the outside of the pressure chamber.

13 Claims, 25 Drawing Sheets

(51) Int. Cl.
*B41J 2/14* (2006.01)
*B41J 2/01* (2006.01)

(52) U.S. Cl.
CPC ..... *B41J 2002/012* (2013.01); *B41J 2202/12* (2013.01); *B41J 2202/20* (2013.01)

(56) References Cited

U.S. PATENT DOCUMENTS

| | | | | |
|---|---|---|---|---|
| 9,102,137 | B2 * | 8/2015 | Koitabashi | B41J 1/00 |
| 2006/0221166 | A1 | 10/2006 | Inoue | |
| 2008/0006176 | A1 | 1/2008 | Houjou | |
| 2009/0087211 | A1 * | 4/2009 | Kadomatsu | G03G 15/11 399/99 |
| 2009/0165937 | A1 | 7/2009 | Inoue et al. | |
| 2011/0316918 | A1 | 12/2011 | Nagashima | |
| 2015/0352836 | A1 * | 12/2015 | Kanasugi | B41J 2/01 347/103 |
| 2016/0303847 | A1 | 10/2016 | Soma et al. | |
| 2017/0217216 | A1 | 8/2017 | Ohnishi et al. | |

OTHER PUBLICATIONS

U.S. Appl. No. 16/022,740, Ryosuke Hirokawa Yoichi Takada Mitsutoshi Noguchi Shingo Okushima Toru Ohnishi, filed Jun. 29, 2018.

Extended European Search Report dated Nov. 26, 2018, in European Patent Application No. 18181737.0.

* cited by examiner $H^{-0.34} \times P^{-0.66} \times W > 1.5$ ... EXPRESSION (1)

$H^{-0.34} \times P^{-0.66} \times W > 1.7$ ... EXPRESSION (2)

INK JET PRINTING APPARATUS AND INK JET PRINTING METHOD

BACKGROUND OF THE INVENTION

Field of the Invention

The present invention relates to an ink jet printing apparatus and an ink jet printing method.

Description of the Related Art

In an ink jet printing system, an image is formed by directly or indirectly applying a liquid composition (ink) containing a coloring material onto a printing medium such as paper. In this operation, curl or cockling may occur due to the excessive absorption of a liquid component in the ink by the printing medium.

Accordingly, a method for rapidly removing a liquid component in ink involves drying a printing medium using a unit such as warm air or infrared ray or involves forming an image on a transfer body, then drying a liquid component contained in the image on the transfer body using thermal energy and the like, and then transferring the image to a printing medium such as paper.

A method which involves absorbing and removing a liquid component from an ink image by bringing a roller-shaped porous body into contact with the ink image without the use of thermal energy has been further proposed as a unit of removing a liquid component contained in an image on a transfer body (Japanese Patent Application Laid-Open No. 2008-19286).

However, depending on an apparatus configuration having a heating unit as disclosed in Japanese Patent Application Laid-Open No. 2008-19286 or a use environment of an apparatus, estimated defects may occur in treatment performed by abutting matter on an ink image on a transfer body, such as a liquid removal step or a transfer step.

The evaporation of water and the like from an ejection orifice of a liquid ejection head is promoted, and this influence may cause change in solvent concentration, coloring material concentration and the like in the vicinity of the ejection orifice. Particularly, ink having an elevated solvent concentration reduces the agglomerating properties of a coloring material and a resin particle upon contact with a reaction solution on a transfer body. When a porous body in a liquid absorbing unit is abutted on an ink image with an insufficient degree of agglomeration, it is considered that the adhesion of ink solid matter to the porous body is facilitated so that a substance originally desired to remain in the ink image moves to the liquid absorbing member, which consequently does not produce the liquid removing effect of interest by a liquid absorbing member. The problems associated with liquid removal by the liquid absorbing member also arise in the case of directly forming an ink image on a printing medium.

Transfer by abutting an ink image on a printing medium without a liquid absorption step using a liquid absorbing member for the ink image on a transfer body cannot produce sufficient transferability due to insufficient agglomeration and might generate transfer residues on the transfer body.

An object of the present invention is to provide an ink jet printing apparatus capable of achieving stable image printing without disturbing an image in image printing that requires treatment of abutting matter on an image containing liquid matter. Another object of the present invention is to provide an ink jet printing method using the ink jet printing apparatus.

SUMMARY OF THE INVENTION

Specifically, one embodiment of the present invention provides an ink jet printing apparatus having: an image forming unit which forms an ink image containing an aqueous liquid component and a coloring material on a discharge receiving medium, the image forming unit including a reaction solution applying unit which applies a reaction solution containing a reactive component for ink thickening to the discharge receiving medium, and an ejection head including a plurality of printing element substrates each having an element which generates energy that is utilized for discharging ink, a pressure chamber which has the element in the inside, and a plurality of ejection orifices which discharge ink; and a liquid absorbing unit for absorbing at least a portion of a liquid component from the ink image by bringing a porous body into contact with the ink image, the liquid absorbing unit including a liquid absorbing member having the porous body, wherein the ink jet printing apparatus further includes a circulation unit which circulates the ink between the inside of the pressure chamber and the outside of the pressure chamber.

Further features of the present invention will become apparent from the following description of exemplary embodiments with reference to the attached drawings.

BRIEF DESCRIPTION OF THE DRAWINGS

FIG. 17A illustrates the first embodiment, and FIG. 17B illustrates the second embodiment.

DESCRIPTION OF THE EMBODIMENTS

Preferred embodiments of the present invention will now be described in detail in accordance with the accompanying drawings.

It is difficult to suppress water evaporation from a nozzle of a liquid ejection head, for example, for an apparatus configuration that performs ink jet printing on a heated transfer body as described in Japanese Patent Application Laid-Open No. 2008-19286, or an apparatus configuration having a printing unit including a liquid ejection head having an ink temperature adjustment mechanism aimed at improving image fastness and stabilizing the discharge of resin particle-containing ink.

The present inventor has studied a unit for attaining a technical issue to highly absorb and remove the liquid matter of interest from an image to be treated without causing image disturbance. As a result, the present inventor has newly found that the technical issue can be attained by controlling the ink circulation between the inside and the outside of a pressure chamber in a liquid ejection head including the pressure chamber and a plurality of ejection orifices which discharge a liquid. The present invention has been made based on the new findings of the present inventor.

Hereinafter, an ink jet printing apparatus according to an embodiment of the present invention will be described with reference to the drawings.

Examples of the ink jet printing apparatus of the present embodiment include: an ink jet printing apparatus configured such that ink is discharged onto a transfer body as a discharge receiving medium to form an ink image, which is then subjected to liquid absorption by a liquid absorbing member, followed by the transfer of the ink image to a printing medium; and an ink jet printing apparatus configured such that an ink image is formed on a printing medium such as paper or cloth as a discharge receiving medium, followed by liquid absorption from the ink image on the printing medium by a liquid absorbing member. In the present invention, the former ink jet printing apparatus is referred to as a transfer-type ink jet printing apparatus below for the sake of convenience. The latter ink jet printing apparatus is referred to as a direct drawing-type ink jet printing apparatus below for the sake of convenience. The transfer body in the transfer-type ink jet printing apparatus can be defined as a medium that transiently retains an ink image.

Hereinafter, the ink jet printing apparatus of the present embodiment will be described.

(Transfer-Type Ink Jet Printing Apparatus)

Figure 1:
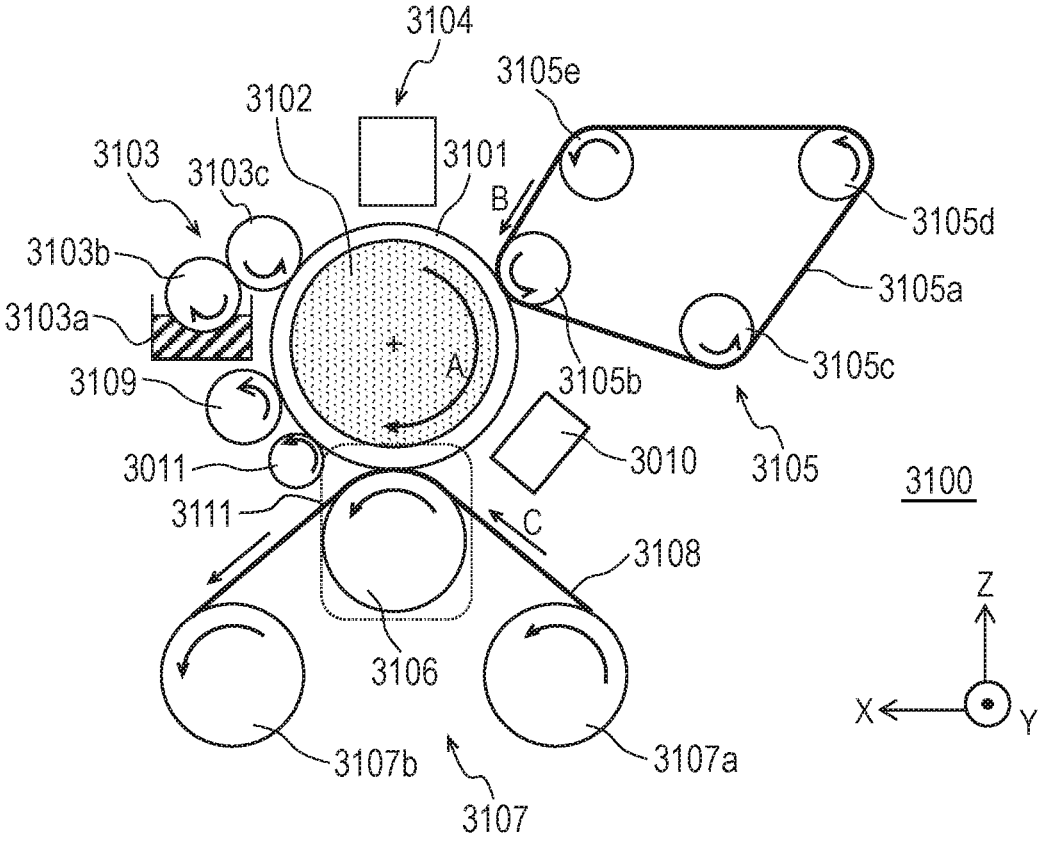
FIG. 1 is a schematic view illustrating one example of the configuration of a transfer-type ink jet printing apparatus according to one embodiment of the present invention.

FIG. 1 is a schematic view illustrating one example of the configuration outline of transfer-type ink jet printing apparatus 3100 of the present embodiment. This printing apparatus is a sheet-fed ink jet printing apparatus producing a printed article by transferring an ink image to printing medium 3108 via transfer body 3101. In the present embodiment, the X direction, the Y direction (anterior-posterior direction of the plane of paper) and the Z direction refer to the width direction (lengthwise direction), the depth direction and the height direction, respectively, of the ink jet printing apparatus 3100. The printing medium 3108 is conveyed in the X direction.

Figure 2:
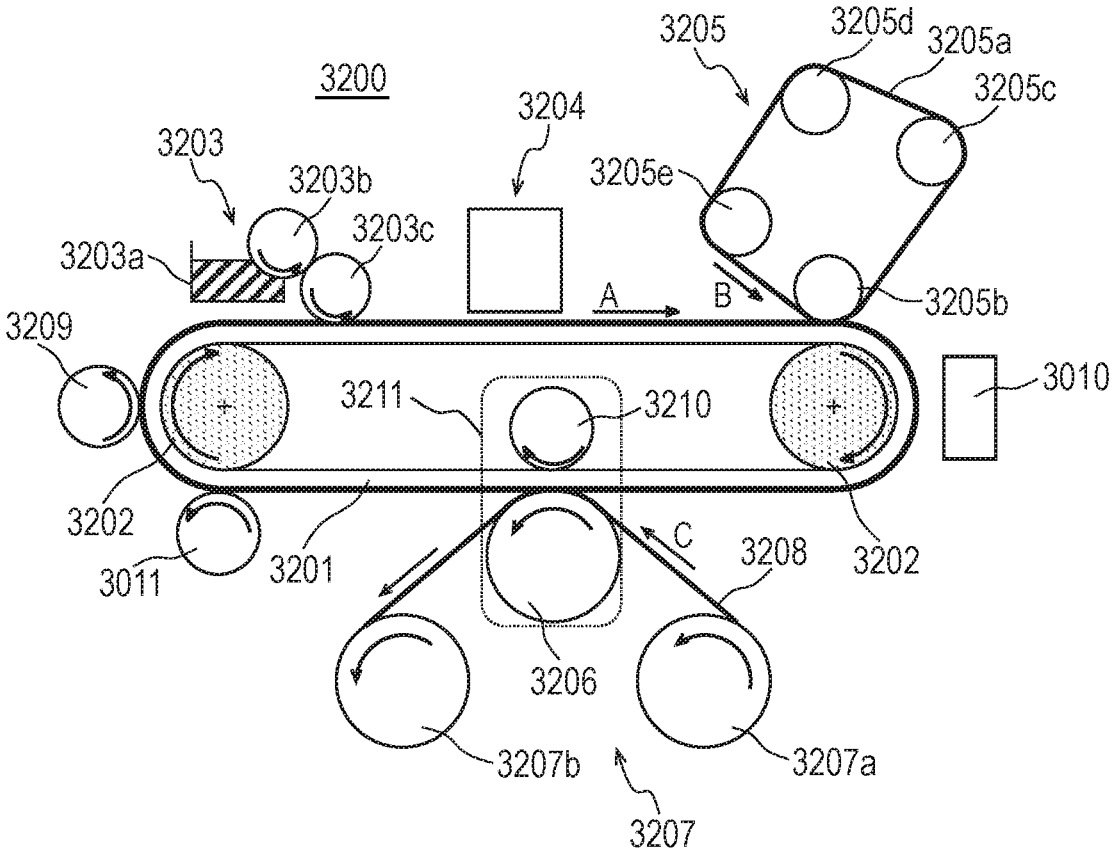
FIG. 2 is a schematic view illustrating another example of the configuration of the transfer-type ink jet printing apparatus according to one embodiment of the present invention.

FIG. 2 illustrates transfer-type ink jet printing apparatus 3200 having belt-shaped transfer body 3201 instead. Reaction solution application apparatus 3203, ink application apparatus 3204, liquid absorption apparatus 3205 which absorbs a liquid component contained in a first image, pressing member 3206 for transfer and conveyance apparatus 3207 for printing medium 3208 are configurationally similar to those of FIG. 1, so that the description is omitted.

The belt-shaped transfer body 3201 can have a smaller heat capacity and facilitates control to increase or decrease temperature, as compared with the drum-shaped transfer body 3101. Reference numeral 3210 denotes an opposed roller which presses the transfer body 3201 against the pressing member 3206 for transfer. Transfer unit 3211 is constituted by the pressing member 3206 and the opposed roller 3210. The opposed roller 3210 can also serve as heating member 3010. The transfer position is not limited to the position of FIG. 2, and the transfer may be performed by using supporting member 3202 which faces the heating member 3010, as an opposed roller. The other configurations are almost the same as those of FIG. 1, so that FIG. 1 will be described below.

The transfer-type ink jet printing apparatus 3100 of FIG. 1 includes transfer body 3101 supported by supporting member 3102. This apparatus also includes: a reaction solution applying unit (reaction solution application apparatus 3103) which applies a reaction solution containing an acid as a reactive component for ink thickening onto the transfer body 3101; and an ink applying unit (ink application apparatus 3104) including liquid ejection head 3 (FIG. 5) which applies ink containing an aqueous liquid medium and a coloring material onto the transfer body 3101 provided with the reaction solution. This forms a first image (ink image) containing the aqueous liquid component and the coloring material, on the transfer body. The reaction solution applying unit and the ink applying unit are also collectively referred to as an image forming unit. The apparatus includes, downstream of the image forming unit: a liquid absorbing unit including a liquid absorbing member having a porous body which comes into contact with the first image so that at least a portion of a liquid component is absorbed from the first image to form a second image; and a transfer unit which transfers the second image to a printing medium. Specifically, the apparatus has: liquid absorption apparatus 3105 which absorbs a liquid component from the ink image on the transfer body; and a transfer unit 3111 including pressing member 3106 for transfer which transfers the liquid component-removed ink image on the transfer body onto printing medium 3108 such as paper. The transfer-type ink jet printing apparatus 3100 may have, if necessary, transfer body cleaning member 3109 which cleans the surface of the transfer body 3101 after transfer. As a matter of course, the transfer body 3101, the reaction solution application apparatus 3103, the liquid ejection head 3 of the ink application apparatus 3104, the liquid absorption apparatus 3105 and the transfer body cleaning member 3109 each have a length sufficiently adaptable to the printing medium 3108 used, in the Y direction.

The transfer body 3101 rotates around rotational axis 3102*a* of the supporting member 3102 in a direction indicated by arrow A of FIG. 1. The transfer body 3101 moves by this rotation of the supporting member 3102. A reaction solution and ink are sequentially applied onto the moving transfer body 3101 by the reaction solution application apparatus 3103 and the ink application apparatus 3104, respectively, to form an ink image on the transfer body 3101. The ink image formed on the transfer body 3101 is allowed, by the movement of the transfer body 3101, to move to a position at which the ink image comes into contact with the liquid absorbing member 3105*a* of the liquid absorption apparatus 3105.

The transfer body 3101 and the liquid absorption apparatus 3105 move in synchronization with the rotation of the transfer body 3101. The ink image formed on the transfer body 3101 undergoes contact with this moving liquid absorbing member 3105*a*. During this contact, the liquid absorbing member 3105*a* removes a liquid component from the ink image on the transfer body. In this contacted state, particularly, it is preferable that the liquid absorbing member 3105*a* can be pressed with predetermined pressing force against the transfer body 3101 to thereby allow the liquid absorbing member 3105*a* to function effectively.

The removal of a liquid component will be described from a different standpoint. This removal can also be interpreted as concentrating the ink constituting the image formed on the transfer body. The concentration of the ink means that the content ratio of solid matter such as the coloring material or a resin contained in the ink to the liquid component is increased by decrease in the amount of the liquid component contained in the ink.

Then, the liquid component-removed ink image after the liquid removal becomes an ink-concentrated state as compared with the ink image before the liquid removal and is further allowed by the transfer body 3101 to move to transfer unit 3111 in contact with printing medium 3108 conveyed by printing medium conveyance apparatus 3107. FIG. 1 illustrates a configuration in which the ink image and the transfer body are heated by heating apparatus 3010 (corresponding to the heating member of FIG. 2) upstream of the transfer unit 3111, though this operation is not essential. Likewise, cooling apparatus 3209 which cools the surface of the transfer body 3101 after transfer is established, but is not essential. And also, cleaning roller 3011 which cleans the surface of the transfer body 3101 after transfer is established. While the ink image after the liquid removal is in contact with the printing medium 3108, the pressing member 3106 presses the transfer body 3101 so that the ink image is transferred onto the printing medium 3108. The ink image thus transferred onto the printing medium 3108 is a reverse image of the ink image before the liquid removal and the ink image after the liquid removal.

In the present embodiment, the reaction solution unreacted with ink remains in a non-image region where no image is formed with the ink, because an image is formed on the transfer body after application of the reaction solution and then the ink. In this apparatus, the liquid absorbing member 3105*a* removes a liquid component of the reaction solution not only from the image but from the unreacted reaction solution by contact.

Thus, the phrase "liquid component is removed from the image" described above does not restrictively mean that the liquid component is removed only from the image, and is used to mean that the liquid component can be removed at least from the image on the transfer body.

The liquid component is not particularly limited as long as the liquid component has fluidity and has an almost constant volume without having a given shape.

Examples of the liquid component include water and an organic solvent contained in the ink or the reaction solution.

Each configuration of the transfer-type ink jet printing apparatus of the present embodiment will be described below.

<Transfer Body>

The transfer body 3101 has a surface layer including an image forming face. Various materials such as resins and ceramics can be appropriately used as a member of the surface layer, and a material having a high compressive modulus of elasticity can preferably be used in terms of durability and the like. Specific examples thereof include acrylic resin, acrylic silicone resin, fluorine-containing resin, and condensates obtained by condensing a hydrolyzable organosilicon compound. The material used may be surface-treated in order to improve the wettability of the reaction solution, transferability and the like. Examples of the surface treatment include frame treatment, corona treatment, plasma treatment, polishing treatment, roughening treatment, active energy line irradiation treatment, ozone treatment, surfactant treatment and silane coupling treatment. A plurality of these treatments may be combined. Also, the surface layer may be provided with an arbitrary surface shape.

The transfer body can also have a compressive layer having a function of absorbing pressure fluctuation. The compressive layer thus established can absorb deformation, disperse local pressure fluctuation, and maintain favorable transferability even at the time of high-speed printing. Examples of the member of the compressive layer include acrylonitrile-butadiene rubber, acrylic rubber, chloroprene rubber, urethane rubber and silicone rubber. The rubber material, when molded, can be mixed with a predetermined amount of a vulcanizing agent, a vulcanization accelerator and the like and further mixed, if necessary, with a foaming agent or a filler such as a hollow fine particle or common salt, and the resulting porous material can preferably be used. As a result, an air bubble portion is compressed with volume change against various pressure fluctuations. Therefore, the porous material is less deformable in a direction other than the direction of the compression. Hence, more stable transferability and durability can be obtained. The porous rubber material has a continuous pore structure where pores continue to each other, and an independent pore structure where pores are independent from each other. In the present invention, any of the structures can be used, and these structures can be used in combination.

The transfer body can further have an elastic layer between the surface layer and the compressive layer. Various materials such as resins and ceramics can be appropriately used as a member of the elastic layer. Various elastomer materials or rubber materials can preferably be used in terms of processing characteristics and the like. Specific examples thereof include fluorosilicone rubber, phenyl silicone rubber, fluorine-containing rubber, chloroprene rubber, urethane rubber, nitrile rubber, ethylene propylene rubber, natural rubber, styrene rubber, isoprene rubber, butadiene rubber, ethylene/propylene/butadiene copolymers and nitrile butadiene rubber. Particularly, silicone rubber, fluorosilicone rubber and phenyl silicone rubber can preferably be used in terms of dimensional stability and durability because of their small compression set. These rubbers can also be used in terms of transferability because of their small modulus of elasticity caused by temperature.

Various adhesives or double-faced tapes may be used for fixing or holding each layer (surface layer, elastic layer and compressive layer) constituting the transfer body, between these layers. Also, a reinforcement layer having a high compressive modulus of elasticity may be established in order to suppress lateral extension or keep strength in installing the transfer body in the apparatus. Alternatively, a woven fabric may be used as the reinforcement layer. The transfer body can be prepared by arbitrarily combining layers made of the materials described above.

The size of the transfer body can be arbitrarily selected according to the printing image size of interest. Examples of the shape of the transfer body specifically include, but are not particularly limited to, sheet, roller, belt and endless web shapes.

<Supporting Member>

The transfer body 3101 is supported on supporting member 3102. Various adhesives or double-faced tapes may be used in a method for supporting the transfer body. Alternatively, a member for installation made of a material such as a metal, a ceramic or a resin may be attached to the transfer body and thereby used to support the transfer body on the supporting member 3102.

The supporting member 3102 is required to have structural strength to some extent from the viewpoint of its conveyance accuracy and durability. A metal, a ceramic, a resin and the like can preferably be used as a material of the supporting member. Particularly, aluminum, iron, stainless, acetal resin, epoxy resin, polyimide, polyethylene, polyethylene terephthalate, nylon, polyurethane, silica ceramic or alumina ceramic can preferably be used for reducing inertia under operating conditions and improving the response of control, in addition to rigidity and dimension accuracy that can resist pressurization at the time of transfer. Alternatively, these materials may be used in combination.

<Reaction Solution Application Apparatus>

The ink jet printing apparatus of the present embodiment has reaction solution application apparatus 3103 which applies a reaction solution to the transfer body 3101. The reaction solution application apparatus 3103 of FIG. 1 is illustrated as a gravure offset roller having reaction solution storage portion 3103*a* which accommodates the reaction solution, and reaction solution applying members 3103*b* and 3103*c* which apply the reaction solution in the reaction solution storage portion 3103*a* onto the transfer body 3101.

The reaction solution application apparatus may be any apparatus that can apply the reaction solution onto the transfer body 3101, and various apparatuses conventionally known can be appropriately used. Specific examples thereof include gravure offset rollers, ink jet heads, die coating apparatuses (die coaters) and blade coating apparatuses (blade coaters). The application of the reaction solution by the reaction solution application apparatus may be performed before or after application of ink as long as the reaction solution can be mixed (reacted) with the ink on the transfer body. The reaction solution is preferably applied before application of ink. The application of the reaction solution before application of ink can also suppress bleeding (mingling of adjacently applied ink droplets) and beading (attraction of an ink droplet landed first to an ink droplet landed later) during image printing based on an ink jet system.

<Reaction Solution>

The reaction solution allows an anionic group-containing component (a resin, a self-dispersible pigment and the like) in ink to agglomerate by contact with the ink, and contains a reactant. Examples of the reactant can include cationic components such as polyvalent metal ions and cationic resins, and organic acids.

Examples of the polyvalent metal ion include: divalent metal ions such as $Ca^{2+}$, $Cu^{2+}$, $Ni^{2+}$, $Mg^{2+}$, $Sr^{2+}$, $Ba^{2+}$ and $Zn^{2+}$; and trivalent metal ions such as $Fe^{3+}$, $Cr^{3+}$, $Y^{3+}$ and $Al^{3+}$. A polyvalent metal salt (which may be a hydrate) constituted by the bonding of the polyvalent metal ion to an anion can be used for allowing the reaction solution to contain the polyvalent metal ion. Examples of the anion can include: inorganic anions such as $Cl^-$, $Br^-$, $I^-$, $ClO^-$, $ClO_2^-$, $ClO_3^-$, $ClO_4^-$, $NO_2^-$, $NO_3^-$, $SO_4^{2-}$, $CO_3^{2-}$, $HCO_3^-$, $PO_4^{3-}$, $HPO_4^{2-}$ and $H_2PO_4^-$; and organic anions such as $HCOO^-$, $(COO^-)_2$, $COOH(COO^-)$, $CH_3COO^-$, $C_2H_4(COO^-)_2$, $C_6H_5COO^-$, $C_6H_4(COO^-)_2$ and $CH_3SO_3^-$. In the case of using the polyvalent metal ion as the reactant, the content (% by mass) thereof based on a polyvalent metal salt in the reaction solution is preferably 1.00% by mass or more to 10.00% by mass or less with respect to the total mass of the reaction solution.

The reaction solution containing the organic acid has buffering ability in an acidic region (less than pH 7.0, preferably pH 2.0 to 5.0) and thereby renders the anionic group of the ink component acidic for agglomeration. Examples of the organic acid can include: monocarboxylic acids such as formic acid, acetic acid, propionic acid, butyric acid, benzoic acid, glycolic acid, lactic acid, salicylic acid, pyrrolecarboxylic acid, furancarboxylic acid, picolinic acid, nicotinic acid, thiophenecarboxylic acid, levulinic acid and coumarinic acid, and salts thereof; dicarboxylic acids such as oxalic acid, malonic acid, succinic acid, glutaric acid, adipic acid, maleic acid, fumaric acid, itaconic acid, sebacic acid, phthalic acid, malic acid and tartaric acid, and salts and hydrogen salts thereof; tricarboxylic acids such as citric acid and trimellitic acid, and salts and hydrogen salts thereof; and tetracarboxylic acids such as pyromellitic acid, and salts and hydrogen salts thereof.

Examples of the cationic resin can include resins having primary to tertiary amine structures and resins having a quaternary ammonium salt structure. Specific examples thereof can include resins having a vinylamine, allylamine, vinylimidazole, vinylpyridine, dimethylaminoethyl methacrylate, ethylenimine or guanidine structure. The cationic resin may be used in combination with an acidic compound or may be subjected to quaternarization treatment in order to enhance solubility in the reaction solution. In the case of using the cationic resin as the reactant, the content (% by mass) of the cationic resin in the reaction solution is preferably 1.00% by mass or more to 10.00% by mass or less with respect to the total mass of the reaction solution.

Water, water-soluble organic solvent, other additives and the like listed as components that can be used in ink mentioned later can be similarly used as components other than the reactant in the reaction solution.

<Ink Application Apparatus>

The ink jet printing apparatus of the present embodiment has ink application apparatus 3104 which applies ink to the transfer body 3101. On the transfer body, the reaction solution and ink are mixed so that an ink image is formed by the reaction solution and the ink. Then, a liquid component is absorbed from the ink image by the liquid absorption apparatus 3105.

Figure 5:
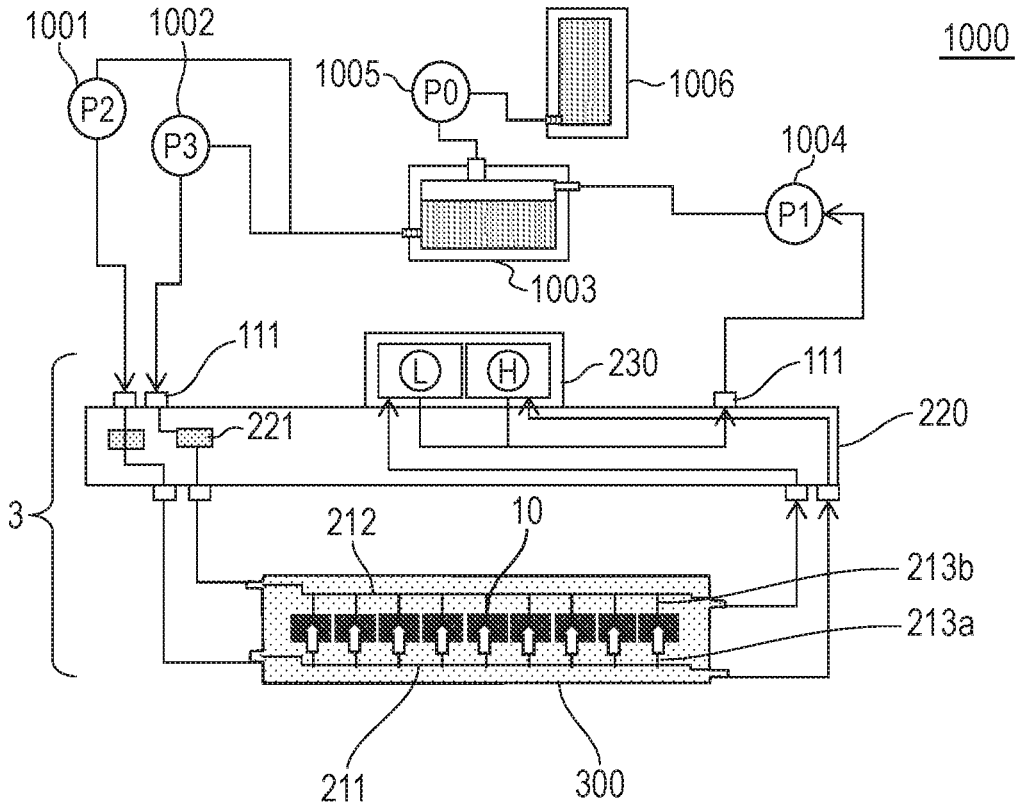
FIG. 5 is a schematic view illustrating a circulation route applied to a printing apparatus according to an embodiment.

In the present embodiment, as illustrated in FIG. 5, liquid ejection apparatus 1000 including liquid ejection head 3 is used as the ink application apparatus which applies ink. Examples of the liquid ejection head include a form that discharges ink by forming air bubbles resulting from film boiling in ink using a thermoelectric converter, a form that discharges ink through an electromechanical converter, and a form that discharges ink by utilizing static electricity. Particularly, a form utilizing a thermoelectric converter is suitably used from the viewpoint of high-speed and high-density printing. In drawing, ink is applied in a necessary amount to each position in response to image signals.

In the present embodiment, the liquid ejection head is a full-line head that runs in the Y direction, and nozzles are arranged in a range that covers the width of an image printing region of a printing medium having the maximum possible size. The ink jet head has, on its underside (transfer body 3101 side), an ink discharging face where the nozzles are open. The ink discharging face faces the surface of the transfer body 3101 via a very small space (approximately several mm).

The amount of the ink applied can be expressed as an image density value, ink thickness and the like. In the present embodiment, the amount of the ink applied ($g/m^2$) is defined as an average value determined by multiplying the mass of each ink dot by the number of ink dots applied and dividing the resulting value by a printing area. The maximum amount of the ink applied in an image region refers to the amount of the ink applied to an area of at least 5 $mm^2$ or more within a region used as information on a discharge receiving medium, from the viewpoint of removing a liquid component in the ink.

The ink application apparatus 3104 may have a plurality of liquid ejection heads in order to apply each color ink onto the transfer body. In the case of forming respective color images using, for example, yellow ink, magenta ink, cyan ink and black ink, the ink application apparatus has four liquid ejection heads which respectively discharge these four ink types onto the transfer body, and these liquid ejection heads are arranged in the X direction.

The ink application apparatus may also include a liquid ejection head which discharges substantially clear, colorless ink free from a coloring material or containing a coloring material at a very low proportion. This clear ink can be used for forming an ink image together with the reaction solution and color ink. For example, this clear ink can be used for improving the gloss of an image. A resin component to be contained therein can be appropriately adjusted so as to create the gloss of an image after transfer. In addition, the discharge position of the clear ink can be controlled. Since it is more desirable that this clear ink should be positioned closer to the surface layer than color ink in a final printed article, the transfer-type printing apparatus is configured such that the clear ink is applied onto the transfer body 3101 before the color ink. Therefore, the liquid ejection head for the clear ink can be disposed upstream of the liquid ejection head for the color ink in the moving direction of the transfer body 3101 which faces the ink application apparatus 3104.

Aside from the gloss purpose, the clear ink can be used for improving the image transferability from the transfer body 3101 to a printing medium. For example, clear ink richer in a component that exerts adhesiveness than color ink is applied to color ink and thereby used as a transferability improving liquid that is applied onto the transfer body 3101. For example, the liquid ejection head for the clear ink for improvement in transferability is disposed downstream of the liquid ejection head for the color ink in the moving direction of the transfer body 3101 which faces the ink application apparatus 3104. The clear ink is located on the uppermost surface of an ink image by applying the color ink onto the transfer body 3101 and then applying the clear ink onto the transfer body thus provided with the color ink. In the transfer of an ink image to a printing medium by the transfer unit 3111, the clear ink on the surface of the ink image adheres to the printing medium 3108 with adhesive force to some extent. This facilitates the movement of the ink image after liquid removal to the printing medium 3108.

The details of the liquid ejection head will be mentioned later.

<Ink>

Each component of the ink according to the present embodiment will be described below.

(Coloring Material)

A pigment or a dye can be used as the coloring material. The content of the coloring material in the ink is preferably 0.5% by mass or more to 15.0% by mass or less, more preferably 1.0% by mass or more to 10.0% by mass or less, with respect to the total mass of the ink.

Specific examples of the pigment can include: inorganic pigments such as carbon black and titanium oxide; and organic pigments such as azo, phthalocyanine, quinacridon, isoindolinone, imidazolone, diketopyrrolopyrrole and dioxazine pigments.

For example, a resin-dispersed pigment with a resin as a dispersant, or a self-dispersing pigment containing a hydrophilic group bonded to the particle surface of the pigment can be used in a pigment dispersion system. Also, for example, a resin-bonded pigment containing a resin-containing organic group chemically bonded to the particle surface of the pigment, or a microcapsule pigment with the particle surface of the pigment coated with a resin and the like can be used.

A resin dispersant capable of dispersing the pigment into an aqueous medium by the action of an anionic group can preferably be used as the resin dispersant for dispersing the pigment into the aqueous medium. A resin as mentioned later can be suitably used as the resin dispersant. A water-soluble resin can be more suitably used. The content (% by mass) of the pigment can be 0.3 or more times to 10.0 or less times in terms of mass ratio to the content of the resin dispersant (pigment/resin dispersant).

A pigment containing an anionic group such as a carboxylic acid group, a sulfonic acid group or a phosphonic acid group bonded directly or via an additional atomic group (—R—) to the particle surface can be used as the self-dispersible pigment. The anionic group can be any of acid and salt types. The salt-type anionic group can be in any of a partially dissociated state and a wholly dissociated state. Examples of the cation serving as a counterion for the salt-type anionic group can include: alkali metal cations; ammonium cations; and organic ammonium cations. Specific examples of the additional atomic group (—R—) can include: linear or branched alkylene groups having 1 to 12 carbon atoms; arylene groups such as a phenylene group and a naphthylene group; carbonyl groups; imino groups; amide groups; sulfonyl groups; ester groups; and ether groups. A group containing these groups in combination may be used.

A dye having an anionic group can preferably be used as the dye. Specific examples of the dye can include azo, triphenylmethane, (aza)phthalocyanine, xanthene and anthrapyridone dyes.

(Resin)

The ink can contain a resin. The content (% by mass) of the resin in the ink is preferably 0.1% by mass or more to 20.0% by mass or less, more preferably 0.5% by mass or more to 15.0% by mass or less, with respect to the total mass of the ink.

The resin can be added to the ink for reasons such as (i) the stabilization of the dispersed state of the pigment, i.e., the resin dispersant mentioned above or assistance thereof, and (ii) improvement in various characteristics of an image to be printed. Examples of the form of the resin can include block copolymers, random copolymers, graft copolymers and combinations thereof. Also, the resin may be in a state dissolved as a water-soluble resin in an aqueous medium or may be in a state dispersed as a resin particle in an aqueous medium. The resin particle does not have to enclose the coloring material.

In the present invention, the term "water-soluble" as to a resin means that a particle having a particle size measurable by a dynamic light scattering method is not formed when the resin is neutralized with an alkali equivalent to its acid number. Whether or not a resin is water-soluble can be determined according to a method given below. First, a liquid (resin solid matter: 10% by mass) containing a resin neutralized with an alkali (sodium hydroxide, potassium hydroxide and the like) equivalent to the acid number is provided. Subsequently, the provided liquid is diluted 10-fold (based on volume) with pure water to prepare a sample solution. Then, the particle size of the resin in the sample solution is measured by the dynamic light scattering method. In this case, the resin can be determined as water-soluble when a particle having a particle size is not measured. The conditions for this measurement can be set to, for example, Set Zero: 30 seconds, the number of measurements: 3 and measurement time: 180 seconds. For example, a particle size analyzer (e.g., trade name "UPA-EX150", manufactured by Nikkiso Co., Ltd.) based on the dynamic light scattering method can preferably be used as a particle size distribution measurement apparatus. As a matter of course, the particle size distribution measurement apparatus, the measurement conditions and the like used are not limited to those described above.

The acid number of the resin is preferably 100 mgKOH/g or more to 250 mgKOH/g or less for a water-soluble resin and is more preferably 5 mgKOH/g or more to 100 mgKOH/g or less for a resin particle. The weight-average molecular weight of the resin is preferably 3,000 or more to 15,000 or less for a water-soluble resin and is more preferably 1,000 or more to 2,000,000 or less for a resin particle. The volume-average particle size of the resin particle measured by the dynamic light scattering method (the measurement conditions are the same as above) is preferably 100 nm or more to 500 nm or less.

Examples of the resin can include acrylic resin, urethane resin and olefin resin. Particularly, acrylic resin or urethane resin can preferably be used.

A resin having a hydrophilic unit and a hydrophobic unit as constitutional units can preferably be used as the acrylic resin. Among others, a resin having a hydrophilic unit derived from (meth)acrylic acid and a hydrophobic unit derived from at least one of a monomer having an aromatic ring and a (meth)acrylic acid ester monomer can preferably be used. Particularly, a resin having a hydrophilic unit derived from (meth)acrylic acid and a hydrophobic unit derived from at least one of styrene and α-methylstyrene monomers can preferably be used. These resins interact easily with the pigment and can therefore be suitably used as the resin dispersant for dispersing the pigment.

The hydrophilic unit is a unit having a hydrophilic group such as an anionic group. The hydrophilic unit can be formed, for example, by polymerizing a hydrophilic monomer having a hydrophilic group. Specific examples of the hydrophilic monomer having a hydrophilic group can include acidic monomers having a carboxylic acid group such as a (meth)acrylic acid, itaconic acid, maleic acid or fumaric acid group, and anionic monomers such as anhydrides or salts of these acidic monomers. Examples of the cation constituting the salt of the acidic monomer can include ions such as lithium, sodium, potassium, ammonium and organic ammonium ions. The hydrophobic unit is a unit which does not have a hydrophilic group such as an anionic group. The hydrophobic unit can be formed, for example, by polymerizing a hydrophobic monomer which does not have a hydrophilic group such as an anionic group. Specific examples of the hydrophobic monomer can include: monomers having an aromatic ring, such as styrene, α-methylstyrene and benzyl (meth)acrylate; and (meth)acrylic acid ester monomers such as methyl (meth)acrylate, butyl (meth) acrylate and 2-ethylhexyl (meth)acrylate.

The urethane resin can be obtained, for example, by reacting polyisocyanate with polyol. Alternatively, the urethane resin may be obtained through further reaction with a chain extender. Examples of the olefin resin can include polyethylene and polypropylene.

(Aqueous Liquid Medium)

The ink can contain an aqueous liquid medium which is water or a mixed solvent of water and a water-soluble organic solvent. Deionized water or ion-exchange water can preferably be used as the water. The content (% by mass) of the water in the aqueous ink is preferably 50.0% by mass or more to 95.0% by mass or less with respect to the total mass of the ink. The content (% by mass) of the water-soluble organic solvent in the aqueous ink is preferably 3.0% by mass or more to 50.0% by mass or less with respect to the total mass of the ink. Any of alcohols, (poly)alkylene glycols, glycol ethers, nitrogen-containing compounds and sulfur-containing compounds and the like usable in ink jet ink can be used as the water-soluble organic solvent.

The total mass of the aqueous liquid medium is preferably 1 or more when the total mass (solid matter) of the coloring material or the coloring material and the resin component contained in the ink is defined as 1.

(Other Additives)

The ink may contain various additives such as an anti-foaming agent, a surfactant, a pH adjuster, a viscosity adjuster, a rust inhibitor, an antiseptic, a mold inhibitor, an antioxidant and a reduction inhibitor, if necessary, in addition to the components described above <Liquid Absorption Apparatus>

In the present embodiment, the liquid absorption apparatus 3105 has liquid absorbing member 3105*a* and pressing member 3105*b* for liquid absorption which presses the liquid absorbing member 3105*a* against an ink image on the transfer body 3101. The shapes of the liquid absorbing member 3105*a* and the pressing member 3105*b* are not particularly limited. For example, as illustrated in FIG. 1, this apparatus can have pressing member 3105*b* having a columnar shape and liquid absorbing member 3105*a* having a belt shape and is configured such that the columnar-shaped pressing member 3105*b* presses the belt-shaped liquid absorbing member 3105*a* against the transfer body 3101. Alternatively, the apparatus may have pressing member 3105*b* having a columnar shape and liquid absorbing member 3105*a* having a cylindrical shape formed on the peripheral surface of the columnar-shaped pressing member 3105*b* and is configured such that the columnar-shaped pressing member 3105*b* presses the cylindrical-shaped liquid absorbing member 3105*a* against the transfer body.

In the present embodiment, the liquid absorbing member 3105*a* preferably have a belt shape in consideration of space and the like within the ink jet printing apparatus.

The liquid absorption apparatus 3105 having such a belt-shaped liquid absorbing member 3105*a* may have a tension member which tensions the liquid absorbing member 3105*a*. In FIG. 1, reference numeral 3105*c* denotes a tension roller as the tension member. In FIG. 1, the pressing member 3105*b* is illustrated as a roller member that rotates, as in the tension roller, but is not limited thereto.

In the liquid absorption apparatus 3105, the liquid absorbing member 3105*a* having a porous body is pressed in contact with the ink image by the pressing member 3105*b* so that a liquid component contained in the ink image is absorbed to the liquid absorbing member 3105*a* to decrease the amount of the liquid component. In addition to this system of bringing the liquid absorbing member in contact, various other approaches conventionally used, for example, a method based on heating, a method of blowing low humid air and a method of reducing pressure may be combined as a method for decreasing the amount of the liquid component in the ink image. Alternatively, the amount of the liquid component may be further decreased by applying these methods to the ink image having a decreased amount of the liquid component after the liquid removal.

<Liquid Absorbing Member>

In the present embodiment, at least a portion of a liquid component is removed from the ink image before liquid removal by absorption in contact with the liquid absorbing member having a porous body to decrease the content of the liquid component in the ink image. When a contact face of the liquid absorbing member for the ink image is defined as a first face, the porous body is disposed on the first face. The liquid absorbing member having such a porous body preferably has a shape capable of absorbing a liquid by circulation which involves moving in tandem with the movement of a discharge receiving medium, coming into contact with the ink image, and then coming into contact again with another ink image before liquid removal at a predetermined cycle. Examples of the shape include endless belt and drum shapes.

(Porous Body)

A porous body having a smaller average pore size on the first face side than that on the second face (which is opposed to the first face) side can preferably be used as the porous body of the liquid absorbing member according to the present embodiment. The pore size is preferably small in order to suppress the adhesion of the coloring material in the ink to the porous body. The average pore size of the porous body at least on the first face side that comes into contact with an image is preferably 10 μm or less. In the present embodiment, the average pore size refers to an average diameter on the surface of the first face or the second face and can be measured by a unit known in the art, for example, a mercury intrusion method, a nitrogen adsorption method or a SEM image observation.

The porous body preferably has a small thickness in order to attain uniformly high air permeability. The air permeability can be indicated by Gurley value defined by JIS P8117. The Gurley value is preferably 10 seconds or less.

However, a thin porous body may not sufficiently secure a necessary capacity for absorbing the liquid component. Therefore, the porous body can have a multilayer configuration. In the liquid absorbing member, the layer that comes into contact with an ink image has the porous body, and a layer that may not come into contact with the ink image may not have the porous body.

Next, an embodiment in which the porous body has a multilayer configuration will be described. In this description, the layer that comes into contact with an ink image is defined as a first layer, and a layer located on a face opposed to the ink image contact face of the first layer is defined as a second layer. The multilayer configuration is also expressed in the order of lamination from the first layer. In the present specification, the first layer is also referred to as an "absorption layer", and the second or more layers are also referred to as "supporting layers".

[First Layer]

In the present embodiment, the material of the first layer is not particularly limited, and any of a hydrophilic material having a contact angle of less than 90° for water and a water-repellent material having a contact angle of 90° or more for water can preferably be used.

The hydrophilic material is preferably selected from, for example, single materials such as cellulose and polyacrylamide and composite materials thereof. Alternatively, a water-repellent material described below may be used after hydrophilization treatment of its surface. Examples of the hydrophilization treatment include methods such as sputter etching, exposure to radiation or $H_2O$ ions and excimer (ultraviolet) laser light irradiation.

The hydrophilic material preferably has a contact angle of 60° or less for water. The hydrophilic material has an effect of soaking up a liquid, particularly, water by capillary force.

On the other hand, the material of the first layer is preferably a water-repellent material having low surface free energy, particularly, fluorinated resin, in order to suppress the adhesion of the coloring material and enhance cleaning properties. Specific examples of the fluorinated resin include polytetrafluoroethylene (PTFE), polychlorotrifluoroethylene (PCTFE), polyvinylidene fluoride (PVDF), polyvinyl fluoride (PVF), perfluoroalkoxy fluororesin (PFA), fluorinated ethylene-propylene copolymer (FEP), ethylene tetrafluoroethylene copolymer (ETFE) and ethylene chlorotrifluoroethylene copolymer (ECTFE). One or two or more of these resins can preferably be used, if necessary. The first layer may be configured such that a plurality of films are laminated. The water-repellent material rarely has an effect of soaking a liquid up by capillary force and may require time for soaking a liquid up upon first contact with an image. Therefore, the first layer can be infiltrated with a liquid having a contact angle of less than 90° for the first layer. This liquid can be infiltrated into the first layer by coating therewith the first face of the liquid absorbing member. It is preferable that this liquid is prepared by mixing water with a surfactant or a liquid having a low contact angle for the first layer.

In the present embodiment, the film thickness of the first layer is preferably 50 μm or less. The film thickness is more preferably 30 μm or less. In Examples of the present embodiment, the film thickness was obtained by measuring film thicknesses at arbitrary 10 points using a non-rotating micrometer OMV_25 (manufactured by Mitutoyo Corp.) and calculating an average value thereof.

The first layer can be produced by a thin porous film production method known in the art. The first layer can be obtained, for example, by obtaining a sheet-like article by a method such as extrusion molding using a resin material and then drawing the sheet-like article into a predetermined thickness. Alternatively, a porous film can be obtained by adding a plasticizer such as paraffin to a material for extrusion molding and removing the plasticizer by heating and the like during drawing. The pore size can be adjusted by appropriately adjusting the amount of the plasticizer added, the draw ratio and the like.

[Second Layer]

In the present embodiment, the second layer is preferably a layer having air permeability. Such a layer may be a nonwoven fabric or a woven fabric of resin fiber. The material of the second layer is not particularly limited and is preferably a material having a contact angle for the first liquid equivalent to or lower than that of the first layer so as to prevent the backward current of the liquid absorbed to the first layer. Specifically, the material of the second layer can preferably be selected from single materials such as polyolefin (polyethylene (PE), polypropylene (PP) and the like), polyurethane, polyamide such as nylon, polyester (polyethylene terephthalate (PET) and the like) and polysulfone (PSF), and composite materials thereof. The second layer is preferably a layer having a larger pore size than that of the first layer.

[Third Layer]

In the present embodiment, the porous body having a multilayer structure may have a 3-layer or more configuration and is not limited. The third (also referred to as third layer) or more layers is preferably nonwoven fabrics from the viewpoint of rigidity. A material similar to that of the second layer can be used.

[Other Materials]

The liquid absorbing member may have a reinforcement member which reinforces the lateral face of the liquid absorbing member, in addition to the porous body having a layered structure as described above. Also, the liquid absorbing member may have a joining member for preparing a belt-like member by connecting the ends in the longitudinal direction of a long sheet-shaped porous body. A nonporous tape material can preferably be used as such a material and can be disposed at a position or a cycle in no contact with an image.

[Method for Producing Porous Body]

The method for forming the porous body by laminating the first layer and the second layer is not particularly limited. The first layer and the second layer may be merely deposited on each other or may be bonded to each other using a method such as adhesive lamination or thermal lamination. In the present embodiment, thermal lamination can preferably be used from the viewpoint of air permeability. Alternatively, for example, a portion of the first layer or the second layer may be melted by heating for adhesive lamination. A fusion material such as a hot-melt powder may be allowed to intervene between the first layer and the second layer, which are in turn adhesively laminated with each other by heating. In the case of laminating the third or more layers, these layers may be laminated at once or may be sequentially laminated. The order of lamination is appropriately selected.

A lamination method which involves heating the porous body while pressurizing the porous body sandwiched between heated rollers can preferably be used in a heating step.

Hereinafter, various conditions and configurations of the liquid absorption apparatus 3105 will be described in detail.

(Pretreatment)

In the present embodiment, the liquid absorbing member 3105*a* having a porous body can be pretreated by a pretreatment unit (not shown in FIGS. 1 and 2) which applies a treatment solution to the liquid absorbing member before contact with an ink image. The treatment solution used in the present embodiment preferably contains water and a water-soluble organic solvent. The water is preferably water deionized by ion exchange and the like. The type of the water-soluble organic solvent is not particularly limited, and any organic solvent known in the art, such as ethanol or isopropyl alcohol can preferably be used. In the pretreatment of the liquid absorbing member used in the present embodiment, the application method is not particularly limited, and dipping or dropwise addition of liquid droplets can preferably be used.

(Pressurization Condition)

The pressure of the liquid absorbing member upon contact with an ink image on the transfer body, i.e., the contact pressure for the transfer body, is preferably 2.9 $N/cm^2$ (0.3 $kgf/cm^2$) or more because the solid-liquid separation of a liquid component in the ink image can be achieved in a shorter time and the liquid component can be removed from the ink image. The contact pressure is more preferably 9.8 $N/cm^2$ or more (1 $kgf/cm^2$ or more), further preferably 19.6 $N/cm^2$ or more (2 $kgf/cm^2$ or more). In the present specification, the pressure of the liquid absorbing member refers to the nip pressure between a discharge receiving medium and the liquid absorbing member and is a value calculated by performing surface pressure measurement using a surface pressure distribution sensor ("I-SCAN", manufactured by Nitta Corp.) and dividing a load in a pressurization region by an area.

(Duration of Action)

The duration of action for the contact of the liquid absorbing member 3105*a* with an ink image is preferably within 50 ms in order to further suppress the adhesion of the coloring material in the ink image to the liquid absorbing member. In the present specification, the duration of action is calculated by dividing a pressure sensing width in the moving direction of the transfer body by the movement speed of the transfer body, in the surface pressure measurement mentioned above. Hereinafter, this duration of action is referred to as a liquid absorption nip time.

In this way, an ink image with the amount of the liquid component decreased by absorbing the liquid component is formed on the transfer body 3101.

<Heating Apparatus>

The ink image after the liquid absorption (second image) on the transfer body 3101 is heated by heating apparatus 3010 disposed in a heating unit. The amount of the liquid component remaining in the second image can be further reduced by the heating of the second image to promote the coating formation of the second image.

When the ink contains a resin component that softens by heating or forms a coating by melting, the second image softens by heating by the heating apparatus 3010 and thereby exhibits improved bonding properties to a printing medium. In this state, for example, the second image is bonded to a printing medium having a low temperature by contact with the printing medium under temperature conditions equal to or higher than the glass transition temperature of the resin component. Thus, favorable transferability can be obtained. The image bonded to the printing medium is solidified and fixed by further cooling, while the fastness of the image can be improved.

Any heating source known in the art is applicable to the heating apparatus 3010 of FIG. 1, and a heating source for radiation heating can preferably be used because of its good heating efficiency. Various lamps are used as the heating source for radiation heating, and an infrared heater such as a halogen lamp can preferably be used because of its high heating efficiency. Also, a reflecting mirror serving as a radiation heat reflecting unit which directs radiation heat from the heating source to the transfer body can preferably be further used for efficiently leading the radiation heat to the transfer body.

The heating apparatus 3010 is configured such that a plurality of radiation heating sources each having a halogen lamp and a reflecting mirror as a pair are arranged in the rotation direction of the transfer body 3101. The halogen lamp and the reflecting mirror used are manufactured by Fintech-Tokyo. The maximum output of the halogen lamp is $10\times10^3$ W/m, and the reflecting mirror used is an aluminum paraboloid mirror having a mirror-polished surface. This paraboloid mirror has a paraboloid-shaped cross section including the shortest line connecting the heating source to the transfer body 3101.

The halogen lamp and the reflecting mirror are slightly longer than the total width of the transfer body 3101 (width in the rotational axial direction of the cylindrical supporting member 3102, i.e., in the depth direction of the plane of paper of FIG. 1). This configuration can heat the total width of the transfer body 3101. A plurality of halogen lamps are connected to a power supply (not shown) and allow radiant flux to be controlled by the supply of electric power for each individual heating source. The control of radiant flux from each heating source is performed by a radiant flux controller.

<Transfer Unit>

The transfer unit 3111 presses the second image on the transfer body 3101 by pressing member 3106 for transfer against printing medium 3108 conveyed by printing medium conveyance unit 3107 and thereby transfers the second image onto the printing medium. After removal of a liquid component contained in the image on the transfer body by the liquid absorbing member, the image is heated by the heating unit and transferred to a printing medium. The resulting printing image can secure coating properties and close contact with the printing medium, while curl, cockling and the like can be suppressed.

The pressing member 3106 is required to have structural strength to some extent from the viewpoint of printing medium conveyance accuracy and durability. A metal, a ceramic, a resin and the like can preferably be used as a material of the pressing member. Particularly, aluminum, iron, stainless, acetal resin, epoxy resin, polyimide, polyethylene, polyethylene terephthalate, nylon, polyurethane, silica ceramic or alumina ceramic can preferably be used for reducing inertia under operating conditions and improving the response of control, in addition to rigidity and dimension accuracy that can resist pressurization at the time of transfer. Alternatively, these materials may be used in combination.

The time of pressing the image on the transfer body 3101 against the printing medium is not particularly limited and is preferably 5 ms or more to 100 ms or less in order to favorably perform the transfer without impairing the durability of the transfer body. The pressing time according to the present embodiment refers to a time for which the printing medium 3108 and the transfer body 3101 are in contact with each other and is a value calculated by performing surface pressure measurement using a surface pressure distribution sensor (product name: I-SCAN, manufactured by Nitta Corp.) and dividing the length in the conveyance direction of a pressurization region by a conveyance speed.

The pressure for pressing the second image on the transfer body 3101 against the printing medium is not particularly limited and is preferably 9.8 N/cm$^2$ (1 kgf/cm$^2$) or more to 294.2 N/cm$^2$ (30 kgf/cm$^2$) or less in order to favorably perform the transfer without impairing the durability of the transfer body. The pressure according to the present embodiment refers to the nip pressure between the printing medium 3108 and the transfer body 3101 and is a value calculated by performing surface pressure measurement using a surface pressure distribution sensor and dividing a load in a pressurization region by an area.

The temperature at the time of pressing by the pressing member 3106 in order to transfer the second image on the transfer body 3101 to the printing medium 3108 is not particularly limited and is preferably equal to or higher than the glass transition point or the softening point of the resin component, if any, contained in the ink. A form including heating apparatuses which heat the second image on the transfer body 3101, the transfer body 3101 and the printing medium 3108 can preferably be used for heating during transfer.

Examples of the shape of the pressing member 3106 include, but are not particularly limited to, a roller shape.

<Liquid Ejection Head>

Hereinafter, the liquid ejection head of the present embodiment will be described with reference to the drawings. However, the description below does not limit the scope of the present invention. As one example, a thermal system that discharges a liquid by generating air bubbles using a heater element as an element which generates energy that is utilized for discharging a liquid is adopted in the present embodiment. However, the present invention can also be applied to liquid ejection heads that is not thermal-energy systems, for example, a piezoelectric system and various other liquid ejection systems, as the element which generates energy.

The liquid printing apparatus (printing apparatus) of the present embodiment is in a form that circulates a liquid such as ink between a tank and the liquid ejection head. However, other forms may be adopted in the present invention as long as ink can be exchanged between the inside of a pressure chamber and the outside of the pressure chamber. These forms are collectively referred to as circulation. Instead of the circulation of a liquid between a tank and the liquid ejection head, for example, a form may be adopted in which two tanks are respectively disposed upstream and downstream of the liquid ejection head, and ink flows from one of the tanks to the other tank to cause the current of the ink within the pressure chamber.

(Basic Configuration)

Figure 12A:
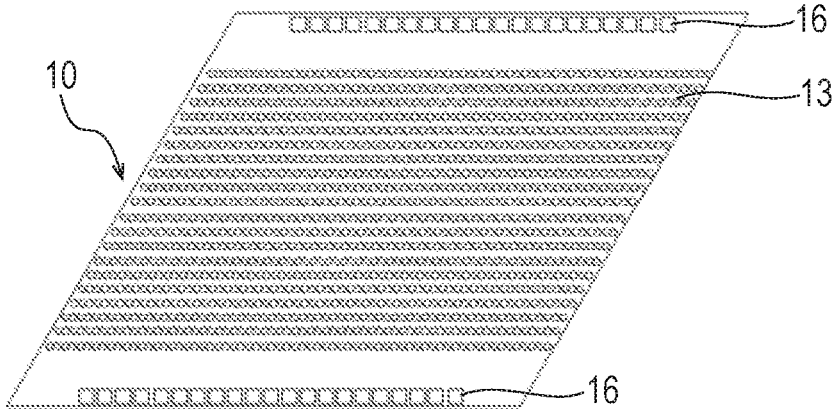
FIG. 12A is a schematic view of a face on the side where ejection orifice 13 is disposed, of printing element substrate 10.

In the present embodiment, the number of ejection orifice arrays that can preferably be used per color is, for example, 20 (FIG. 12A). Therefore, printing data is appropriately distributed to a plurality of ejection orifice arrays for printing. As a result, very high-speed printing is achieved. Even if a disabled ejection orifice is present, reliability is improved by compensating for the ejection orifice by an ejection orifice of a different row located at a position corresponding to the conveyance direction of a printing medium. Thus, this configuration is suitable for commercial printing and the like.

(Description of Circulation Route)

FIG. 5 is a schematic view illustrating a circulation route for use in liquid ejection apparatus 1000 applied to the printing apparatus of the present embodiment. Both of two pressure adjustment mechanisms constituting negative pressure control unit 230 are mechanisms which control pressure upstream of the negative pressure control unit 230 within a given range of fluctuation centered on the desired set pressure (mechanical components having the same action as that of a so-called "back-pressure regulator"). Second circulation pump 1004 acts as a negative pressure source that reduces pressure downstream of the negative pressure control unit 230. First circulation pump (high-pressure side) 1001 and first circulation pump (low-pressure side) 1002 are disposed upstream of the liquid ejection head, and the negative pressure control unit 230 is disposed downstream of the liquid ejection head. These control units are implemented as partial functions of printing controller 3303.

The negative pressure control unit 230 works to stabilize pressure fluctuation upstream thereof (i.e., on the liquid ejection unit 300 side) within a given range centered on predetermined set pressure, even if a flow rate fluctuates due to change in printing duty in performing printing by the liquid ejection head 3. As illustrated in FIG. 5, a region downstream of the negative pressure control unit 230 can be pressurized by the second circulation pump 1004 via liquid supplying unit 220. This can suppress the influence of hydraulic head pressure of buffer tank 1003 on the liquid ejection head 3 and can therefore expand the range of choice of the layout of the buffer tank 1003 in the liquid ejection apparatus 1000. Instead of the second circulation pump 1004, for example, a water head tank established with predetermined water head difference from the negative pressure control unit 230 is also applicable. The buffer tank 1003 which is a sub-tank is connected to the main tank 1006 and includes an atmosphere communication opening (not illustrated) to communicate the inside of the tank with the outside and thus can discharge bubbles inside the ink to the outside. The replenishing pump 1005 is provided between the buffer tank 1003 and the main tank 1006. The replenishing pump 1005 delivers the ink from the main tank 1006 to the buffer tank 1003 after the ink is consumed by the ejection (the discharge) of the ink from the ejection opening of the liquid ejection head 3 in the printing operation and the suction collection operation.

As illustrated in FIG. 5, the negative pressure control unit 230 includes two pressure adjustment mechanisms respectively set to control pressures different from each other. Of these two negative pressure adjustment mechanisms, a high-pressure side (indicated by H in FIG. 5) and a low-pressure side (indicated by L in FIG. 5) are connected to common supply flow path 211 and common recovery flow path 212, respectively, within the liquid ejection unit 300 by way of the inside of the liquid supplying unit 220. The two negative pressure adjustment mechanisms set the pressure of the common supply flow path 211 to be relatively higher than that of the common recovery flow path 212 so that ink flows from the common supply flow path 211 into the common recovery flow path 212 via each individual flow path 213 (213*a*, 213*b*) and the internal flow path of each printing element substrate 10 (arrows of FIG. 5).

(Description of Liquid Ejection Head Configuration)

Figure 6A:
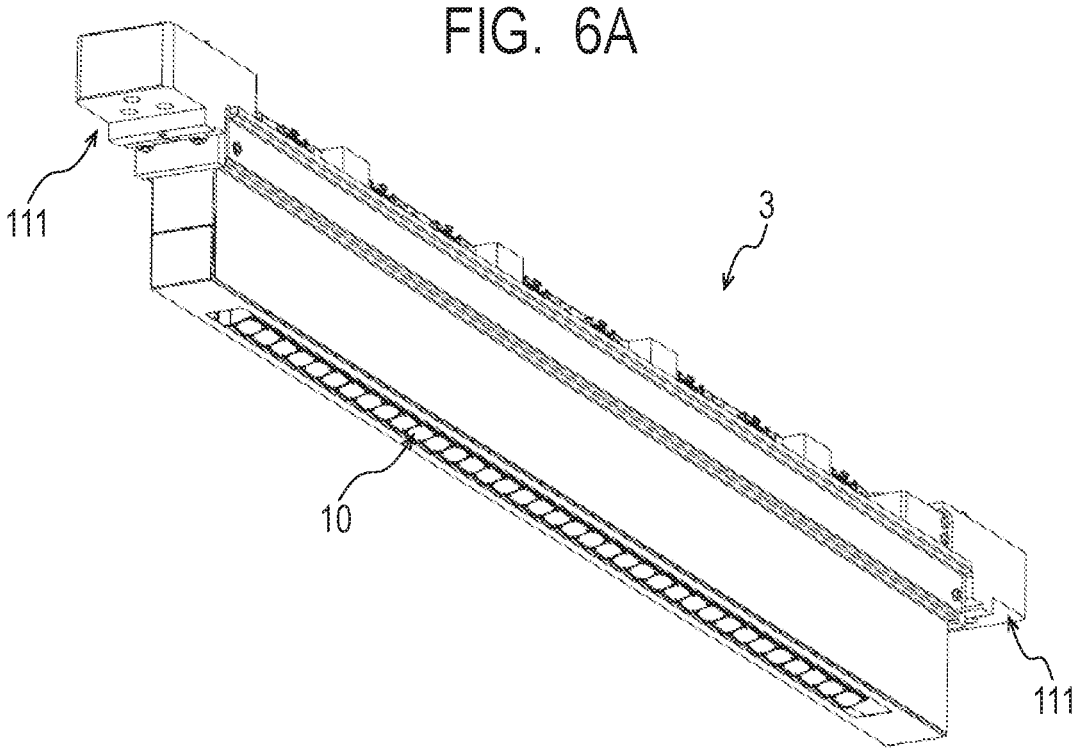
FIGS. 6A and 6B are perspective views of liquid ejection head 3 according to an embodiment.
Figure 6B:
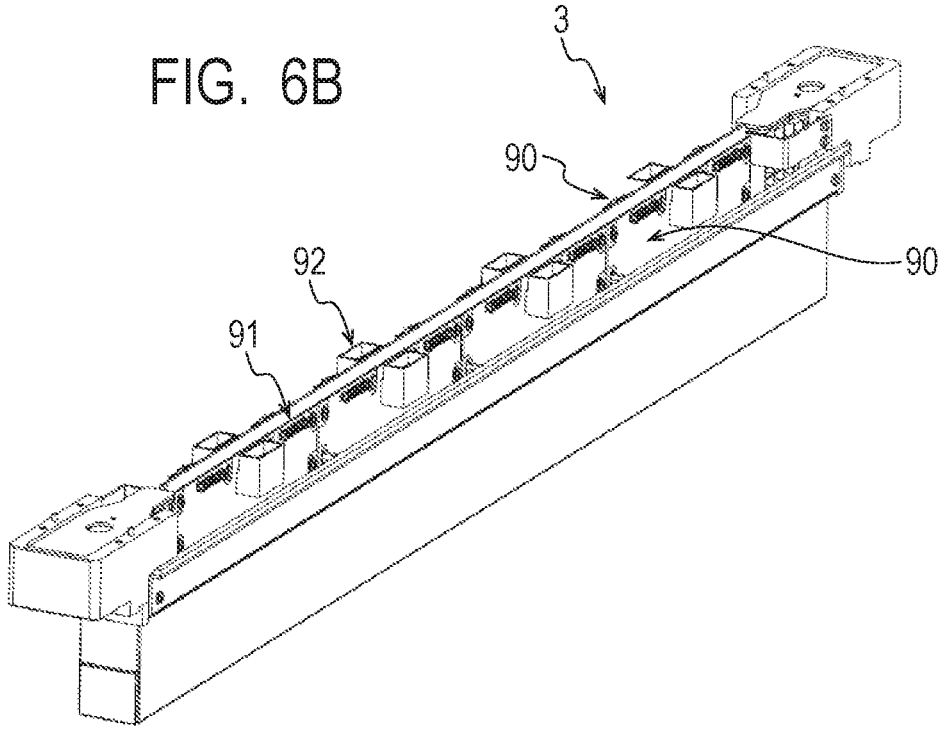

The configuration of the liquid ejection head 3 will be described. Each of FIGS. 6A and 6B is a perspective view of the liquid ejection head 3 according to the present embodiment. The liquid ejection head 3 is a line-type ink jet printing head capable of printing using a liquid of one color, including a plurality of printing element substrates 10 linearly arranged in the longitudinal direction of the liquid ejection head 3. The liquid ejection head 3 include liquid connecting units 111, signal input terminals 91 and power supply terminals 92. In the liquid ejection head 3, the signal input terminals 91 and the power supply terminals 92 are disposed on both sides of the liquid ejection head 3. This is because of reducing voltage drop or signal transmission delay in a wiring unit disposed in the printing element substrate 10.

Figure 7:
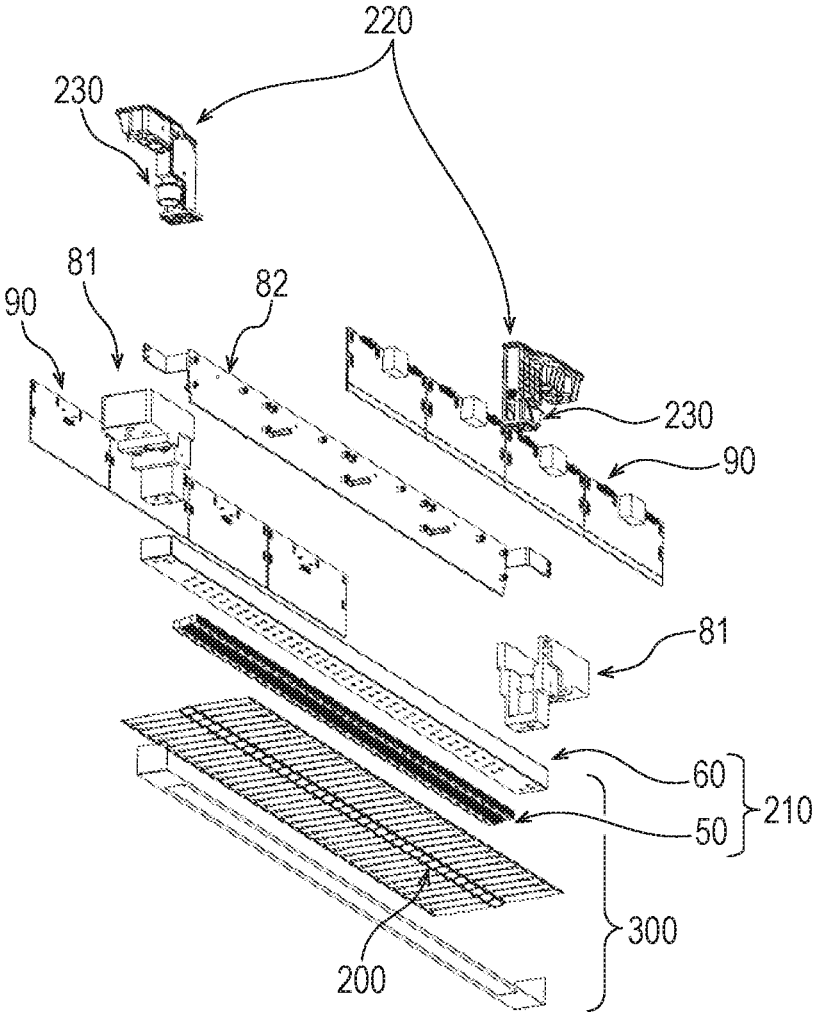
FIG. 7 is a perspective exploded view of the liquid ejection head 3 according to an embodiment.

FIG. 7 is a perspective exploded view of the liquid ejection head 3 and illustrates each component or unit constituting the liquid ejection head 3 on a function basis. The rigidity of the liquid ejection head of the present embodiment is ensured by second flow path member 60 included in liquid ejection unit 300. In the present embodiment, liquid ejection unit supporting units 81 are connected to both ends of the second flow path member 60. This liquid ejection unit 300 is mechanically attached to a carriage of the liquid ejection apparatus 1000 to perform the positioning of the liquid ejection head 3. Liquid supplying units 220 including negative pressure control units 230 and electric wiring substrates 90 attached to electric wiring substrate supporting unit 82 are attached to the liquid ejection unit supporting unit 81. Filters (not shown) are respectively embedded in two liquid supplying units 220. Two negative pressure control units 230 are set to respectively control pressure as different relatively high and low negative pressures. When the high-pressure and low-pressure side negative pressure control units 230 are respectively disposed at both ends of the liquid ejection head 3 as illustrated in this drawing, liquid flows in common supply flow path 211 and common recovery flow path 212 which extend in the longitudinal direction of the liquid ejection head 3 are opposed to each other. This promotes the heat exchange between the common supply flow path 211 and the common recovery flow path 212 and reduces the difference between the internal temperatures of these two common flow paths. Therefore, a plurality of printing element substrates 10 disposed along the common flow paths rarely differ in temperature and, advantageously, are less likely to cause uneven printing ascribable to difference in temperature.

Figure 10:
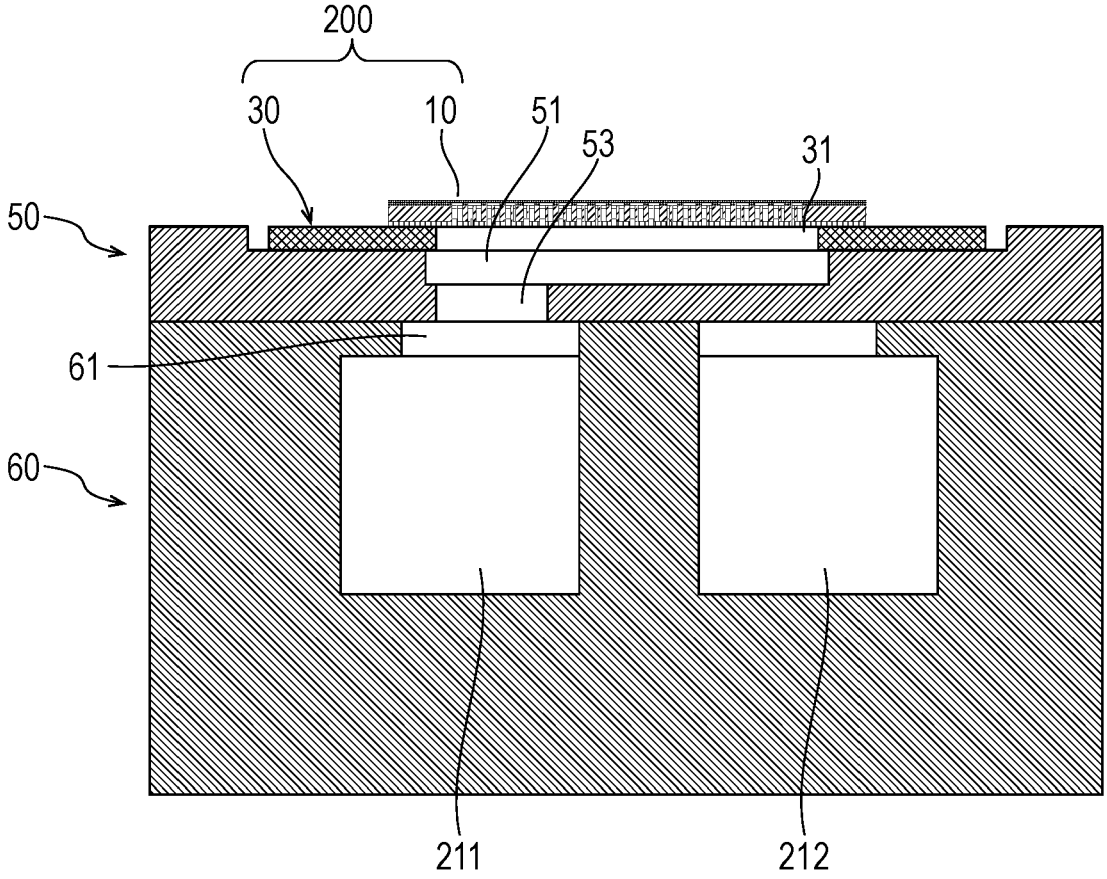
FIG. 10 is a diagram illustrating the cross section taken along the 1*c*-1*d* line of FIG. 9.

Next, the flow path member 210 of the liquid ejection unit 300 will be described in detail. As illustrated in FIG. 7, the flow path member 210 is a laminate of first flow path member 50 and second flow path member 60 and distributes a liquid supplied from liquid supplying unit 220 to each ejection module 200. The flow path member 210 also functions as a flow path member for bringing back a liquid refluxed from the ejection module 200 to the liquid supplying unit 220. The second flow path member 60 of the flow path member 210 is a flow path member having common supply flow path 211 and common recovery flow path 212 in the inside, as illustrated in FIG. 10, and has a function of being mainly responsible for the rigidity of the liquid ejection head 3. Therefore, a material having sufficient corrosion resistance to a liquid and high mechanical strength can preferably be used as a material of the second flow path member 60. Specifically, SUS, Ti, alumina and the like can preferably be used.

Figure 8A:
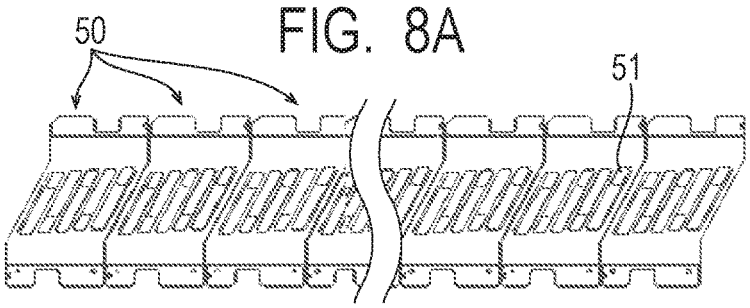
FIG. 8A is a diagram illustrating a face on the side where ejection module 200 is mounted, of first flow path member 50.
Figure 8B:
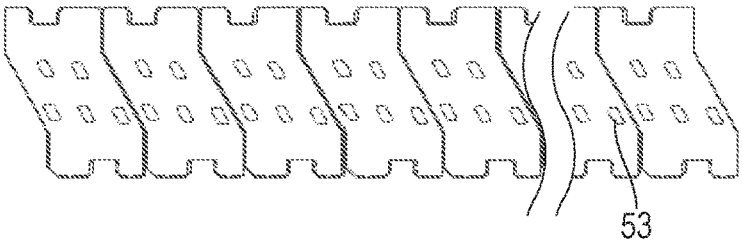
FIG. 8B is a diagram illustrating a face on the side abutted on second flow path member 60, which is the other side thereof.
Figure 8C:
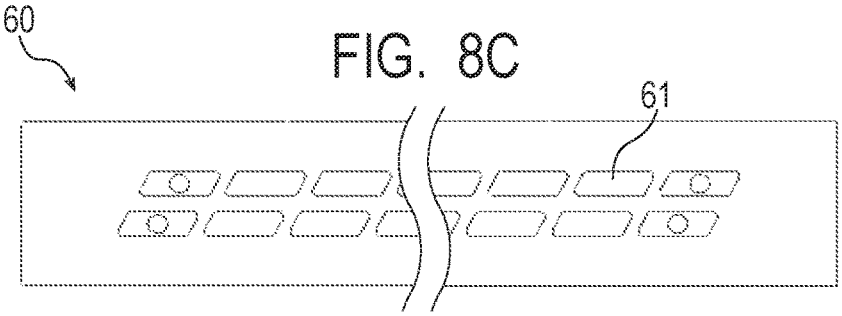
FIG. 8C is a diagram illustrating a face on the side abutted on the first flow path member 50, of the second flow path member 60.
Figure 8D:
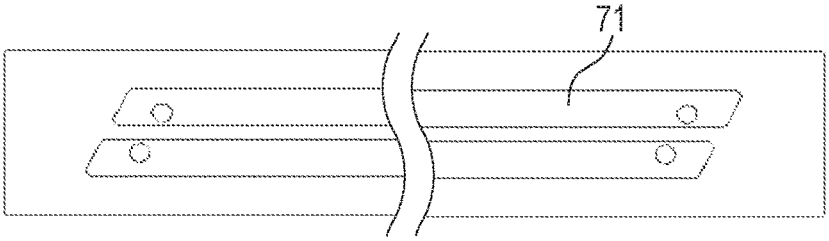
FIG. 8D is a diagram illustrating the cross section of a central portion in the thickness direction of the second flow path member 60.
Figure 8E:
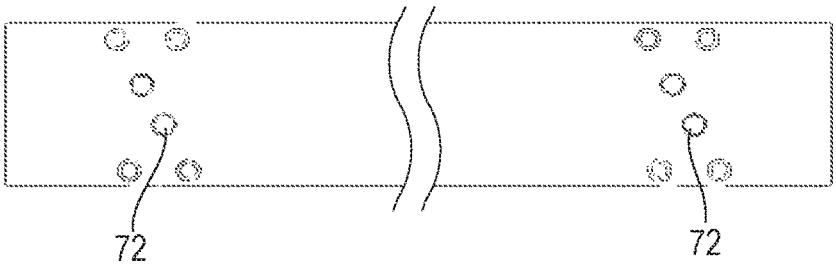
FIG. 8E is a diagram illustrating a face on the side abutted on liquid supplying unit 220, of the second flow path member 60.

FIG. 8A illustrates a face on the side where ejection module 200 is mounted, of first flow path member 50. FIG. 8B is a diagram illustrating a face on the side abutted on second flow path member 60, which is the other side thereof. The first flow path members 50 are a plurality of adjacently arranged members corresponding to ejection modules 200. The first flow path members having such a divided structure and including a plurality of arranged modules can be adapted to the length of the liquid ejection head and can therefore be suitably applied, particularly, to, for example, relatively long-scale liquid ejection heads corresponding to lengths equal to or larger than B2 size. As illustrated in FIG. 8A, communication port 51 of the first flow path member 50 communicates fluidically with the ejection module 200. As illustrated in FIG. 8B, individual communication port 53 of the first flow path member 50 communicates fluidically with communication port 61 of the second flow path member 60. FIG. 8C illustrates a face on the side abutted on the first flow path member 50, of the second flow path member 60. FIG. 8D illustrates the cross section of a central portion in the thickness direction of the second flow path member 60. FIG. 8E is a diagram illustrating a face on the side abutted on liquid supplying unit 220, of the second flow path member 60. One of common flow path grooves 71 of the second flow path member 60 is the common supply flow path 211 illustrated in FIG. 9, and the other groove is the common recovery flow path 212 illustrated in FIG. 9. A liquid is supplied from one end to the other end of each flow path along the longitudinal direction of the liquid ejection head 3. The longitudinal directions of liquids in the common supply flow path 211 and the common recovery flow path 212 are directions opposite to each other.

Figure 9:
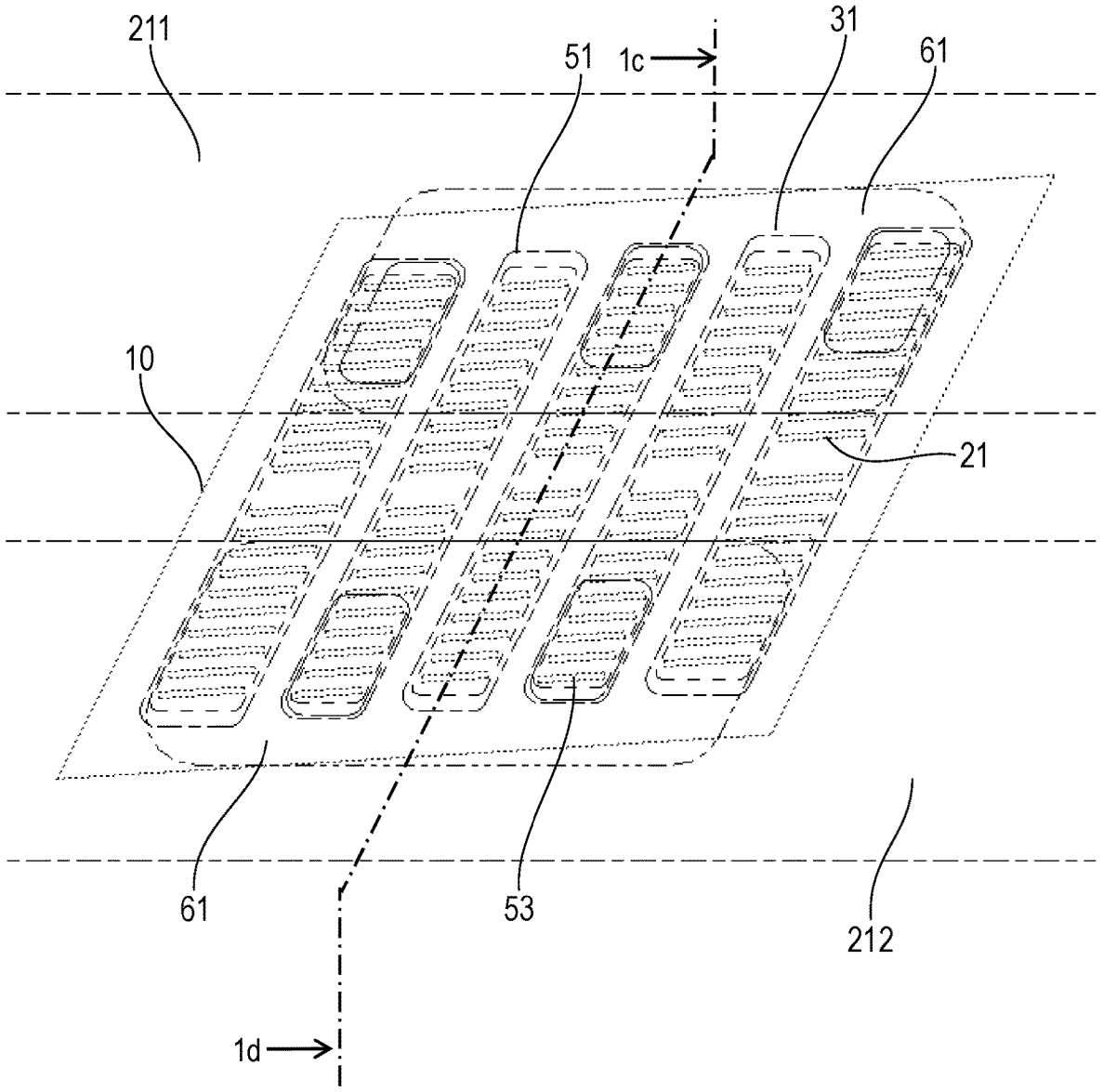
FIG. 9 is a perspective view illustrating the relation of connection of a liquid between printing element substrate 10 and flow path member 210.

FIG. 9 is a perspective view illustrating the relation of connection of a liquid between printing element substrate 10 and flow path member 210. As illustrated in FIG. 9, one set of common supply flow path 211 and common recovery flow path 212 which extend in the longitudinal direction of the liquid ejection head 3 are disposed within the flow path member 210. Communication ports 61 of second flow path member 60 are connected in alignment with individual communication ports 53 of first flow path member 50. A liquid supply route is formed to communicate from communication ports 72 of the second flow path member 60 via the common supply flow path 211 to communication ports 51 of the first flow path member 50. Likewise, another liquid supply route is also formed to communicate from the communication ports 72 of the second flow path member 60 via the common recovery flow path 212 to the communication ports 51 of the first flow path member 50.

FIG. 10 is a diagram illustrating the cross section taken along the 1*c*-1*d* line of FIG. 9. As illustrated in this drawing, the common supply flow path is connected to the ejection module 200 via the communication port 61, the individual communication port 53 and the communication port 51. Referring to FIG. 9, it is evident that in another cross section, individual recovery flow paths are connected to the ejection modules 200 through similar routes. A flow path that communicates with each ejection orifice 13 (see FIG. 12A) is formed in each ejection module 200 and printing element substrate 10. A portion or the whole of a supplied liquid can be circulated by passing through the ejection orifice 13 (pressure chamber 23 (see FIG. 13)) during quiescent ejection operation. The common supply flow path 211 and the common recovery flow path 212 are connected to negative pressure control unit 230 (high-pressure side) and negative pressure control unit 230 (low-pressure side), respectively, via liquid supplying unit 220. Therefore, the differential pressure generates a flow from the common supply flow path 211 through the ejection orifice 13 (pressure chamber 23) of the printing element substrate 10 to the common recovery flow path 212.

(Description of Ejection Module)

Figure 11A:
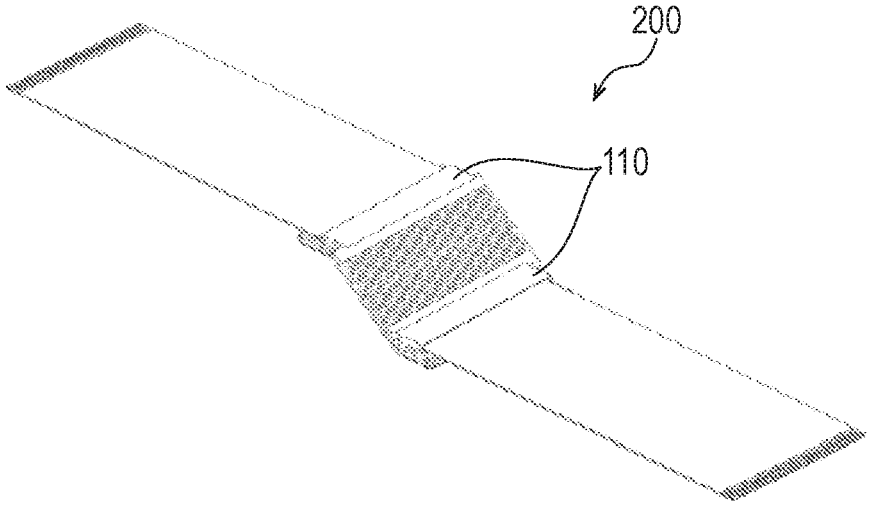
FIG. 11A illustrates a perspective view of one ejection module 200.
Figure 11B:
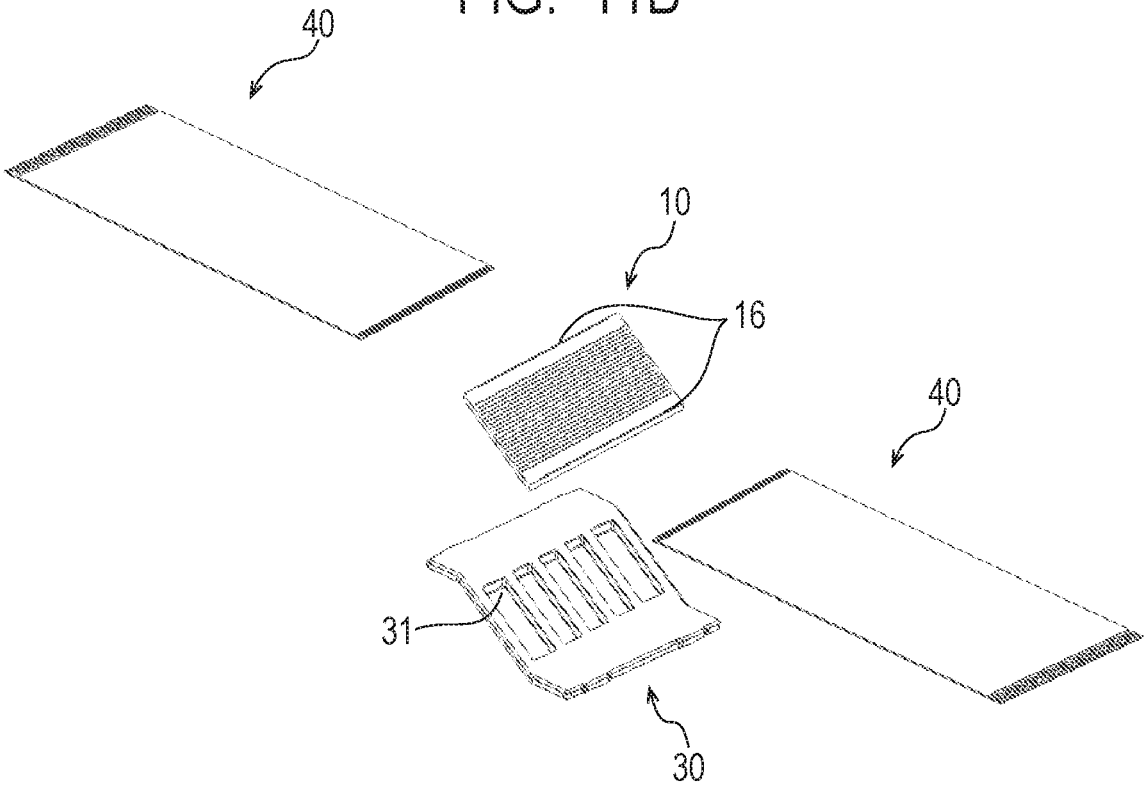
FIG. 11B illustrates an exploded view thereof.

FIG. 11A illustrates a perspective view of one ejection module 200. FIG. 11B illustrates an exploded view thereof. A plurality of terminals 16 are respectively disposed in side portions (long side portions of the printing element substrate 10) along the directions of a plurality of ejection orifice arrays in the printing element substrate 10. Two flexible wiring substrates 40 which are electrically connected thereto are also disposed per printing element substrate 10. This is because the number of ejection orifice arrays disposed in the printing element substrate 10 is 20, leading to a large number of wires. Specifically, this is aimed at keeping short the maximum distance from terminals 16 to printing elements 15 disposed in response to the ejection orifice arrays, and reducing voltage drop or signal transmission delay in a wiring unit within the printing element substrate 10. Also, liquid communication ports 31 of supporting member 30 are disposed in the printing element substrate 10 and are open so as to straddle all the ejection orifice arrays.

(Description of Printing Element Substrate Structure)

Figure 12B:
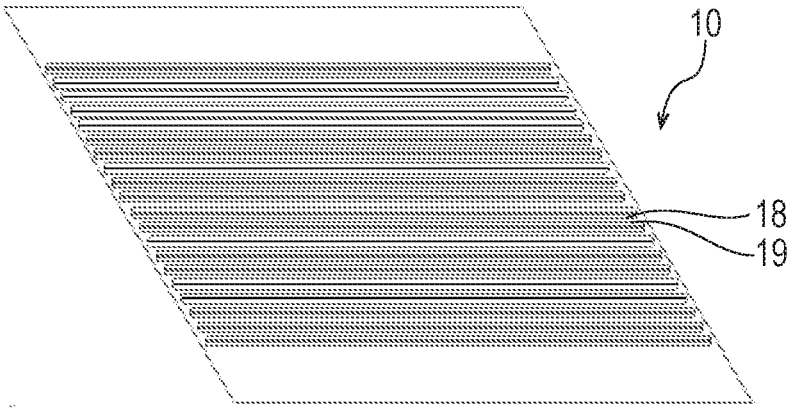
FIG. 12B is a schematic view illustrating the other side of the face of FIG. 12A.
Figure 12C:
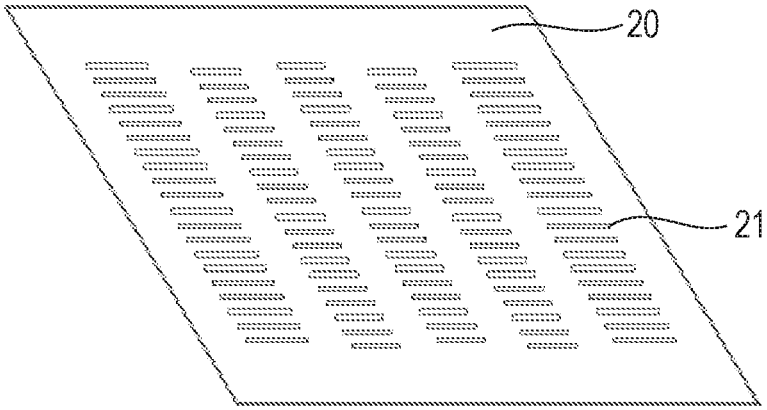
FIG. 12C is a schematic view illustrating a cover plate disposed on the back of the printing element substrate 10.

FIG. 12A is a schematic view of a face on the side where ejection orifice 13 is disposed, of printing element substrate 10. FIG. 12B is a schematic view illustrating the other side of the face of FIG. 12A. FIG. 12C is a schematic view illustrating a cover plate disposed on the back of the printing element substrate 10. A plurality of ejection orifice arrays are formed in ejection orifice forming member 12 of the printing element substrate 10. Hereinafter, the direction where the ejection orifice arrays having a plurality of arranged ejection orifices 13 extend is referred to as a "ejection orifice array direction".

Figure 13:
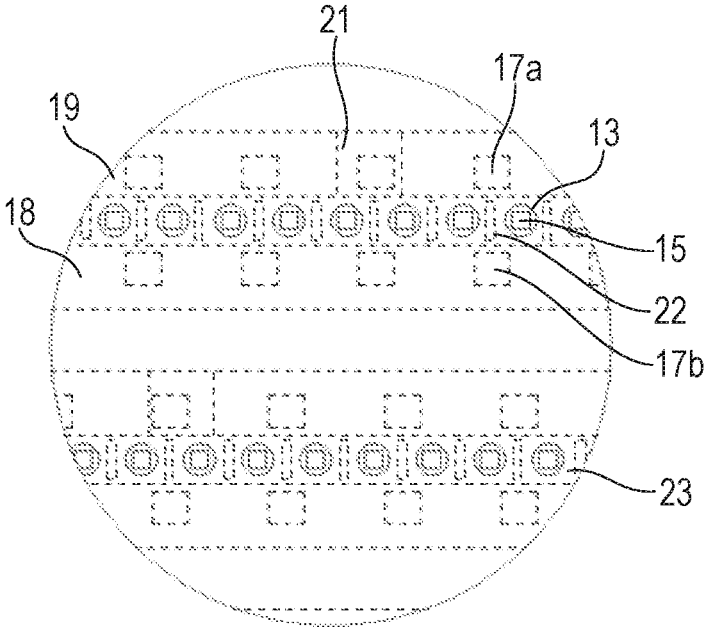
FIG. 13 is a schematic view illustrating a face of printing element substrate 10 from which cover member 20 disposed on the back of the printing element substrate 10 has been removed.

FIG. 13 is a schematic view illustrating a face of printing element substrate 10 from which cover member 20 disposed on the back of the printing element substrate 10 has been removed. As illustrated in FIG. 13, printing element 15 which serves as a heater element for bubbling a liquid by thermal energy is disposed at a position corresponding to each ejection orifice 13. Pressure chamber 23 having the printing element 15 in the inside is defined by partition walls 22. The printing element 15 is electrically connected to the terminals 16 of FIG. 12A by electric wiring (not shown) disposed in the printing element substrate 10 and boils a liquid by heating based on pulse signals input via electric wiring substrate 90 (FIG. 7) and flexible wiring substrate 40 (FIG. 11B) from a control circuit of the liquid ejection apparatus 1000. The liquid is discharged from the ejection orifice 13 by the action of bubbling by this boiling. Liquid supply paths 18 and liquid recovery paths 19 are alternately disposed along the ejection orifice array direction on the back of the printing element substrate 10. The liquid supply path 18 and the liquid recovery paths 19 are flow paths that extend in the ejection orifice array direction in the printing element substrate 10 and communicate with the ejection orifices 13 via supply ports 17*a* and recovery ports 17*b*, respectively. Opening 21 which communicates with liquid communication port 31 of supporting member 30 is further disposed in the cover member 20.

(Description of Positional Relationship Between Printing Element Substrates)

Figure 14:
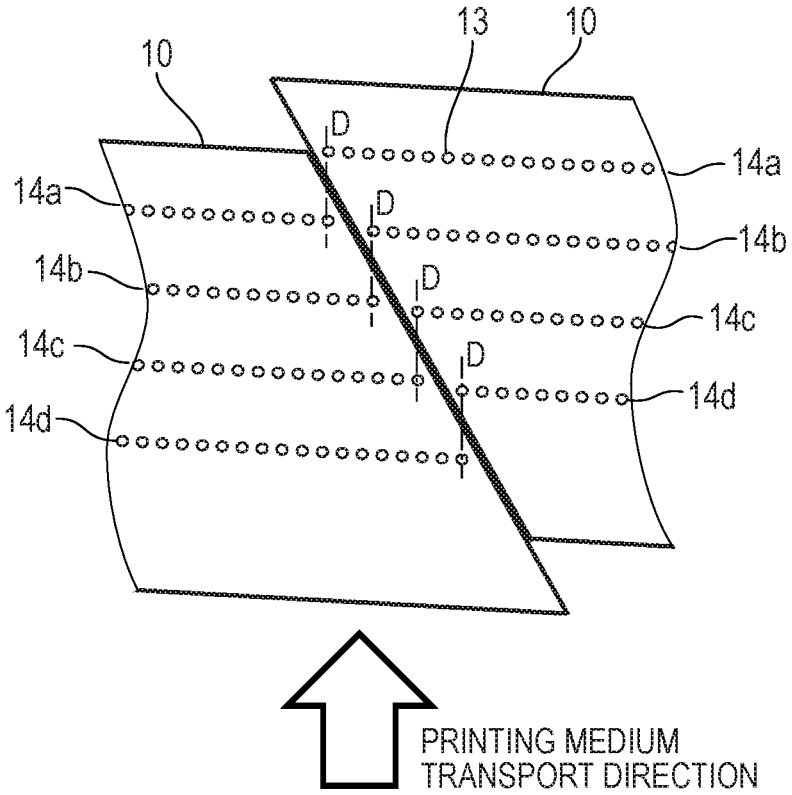
FIG. 14 is a plane view illustrating, in a partially enlarged manner, printing element substrate flanking portions of two adjacent ejection modules.

FIG. 14 is a plane view illustrating, in a partially enlarged manner, printing element substrate flanking portions of two adjacent ejection modules. As illustrated in FIGS. 12A to 12C, in the present embodiment, a substantially parallelogram printing element substrate is used. As illustrated in FIG. 14, in each printing element substrate 10, each ejection orifice array (14*a* to 14*d*) having arranged ejection orifices 13 is inclined with a given angle with respect to the conveyance direction of a printing medium. As a result, at least one ejection orifice of the ejection orifice array of one printing element substrate overlaps with that of another printing element substrate in the conveyance direction of a printing medium, in the flanking portions of these printing element substrates 10. In FIG. 14, two ejection orifices on the D line are in a relationship overlapping with each other. Such placement can diminish the appearance of black streaks or speckles in a printing image by the drive control of the overlapping ejection orifices, even if the position of the printing element substrate 10 somewhat gets out of its predetermined position. When a plurality of printing element substrates 10 are linearly (in-line) arranged, not in a staggered pattern, the configuration as illustrated in FIG. 14 can also make measures against black streaks or speckles at the joint between the printing element substrates 10, while preventing increase in the length in the printing medium conveyance direction of the liquid ejection head. In the present embodiment, the principal plane of the printing element substrate is a parallelogram. However, the present invention is not limited by this shape, and the configuration of the present invention can also be applied to printing element substrates having, for example, rectangular, trapezoidal and other shapes.

(Configuration in Vicinity of Ejection Orifice)

Next, some embodiments of the present invention will be described about the ejection orifices and their neighboring structures in the liquid ejection heads of the first and second forms described above.

Figure 15A:
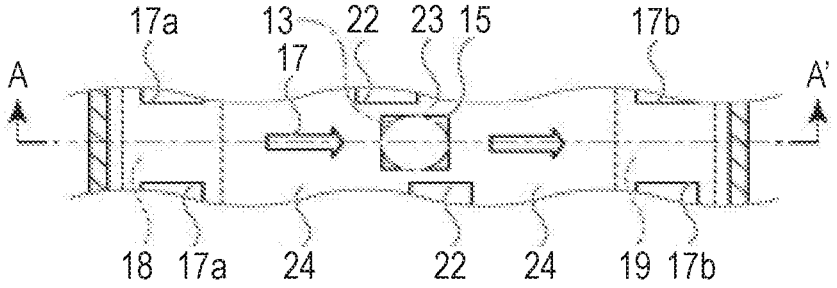
FIGS. 15A, 15B and 15C are diagrams illustrating the structures of an ejection orifice and its neighboring ink flow path in a liquid ejection head according to the first embodiment of the present invention.
Figure 15B:
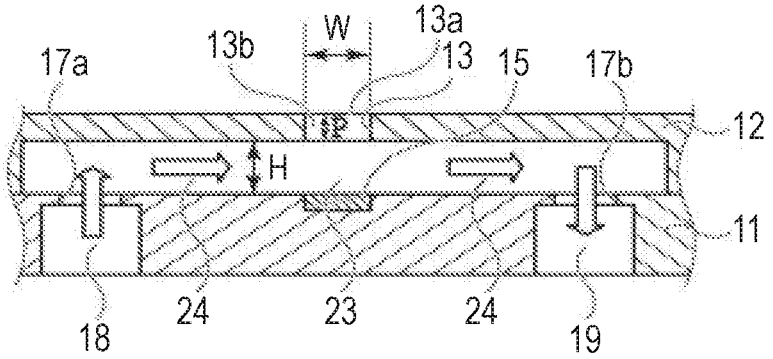
Figure 15C:
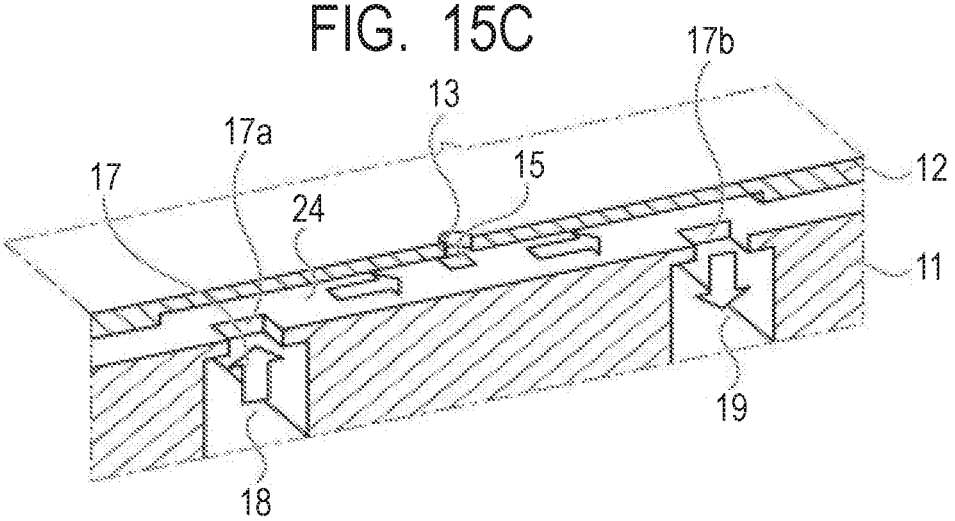

Each of FIGS. 15A to 15C is a diagram illustrating the structures of an ejection orifice and its neighboring ink flow path in the liquid ejection head according to the first embodiment of the present invention. FIG. 15A is a plane view of the ink flow path and the like, viewed from the side where ink is discharged. FIG. 15B illustrates the cross section taken along the A-A' line in FIG. 15A. FIG. 15C is a perspective view of the cross section taken along the A-A' line of FIG. 15A.

As illustrated in these drawings, the ink circulation mentioned above with reference to FIG. 5 and the like generates ink flow 17 in pressure chamber 23 provided with printing element 15 and flow paths 24 upstream and downstream thereof on substrate 11 of the liquid ejection head. Specifically, by differential pressure resulting in ink circulation, ink supplied from liquid supply path (supply flow path) 18 via supply port 17 disposed in the substrate 11 flows through the flow path 24, the pressure chamber 23 and the flow path 24 and arrives at liquid recovery path (outflow path) 19 via recovery port 17*b*.

Along with the ink flow mentioned above, the space from the printing element (energy generation element) 15 to the ejection orifice 13 above the element is filled with ink when discharge is not performed, and ink meniscus (ink interface 13*a*) is formed in the vicinity of an end in the ejection direction of the ejection orifice 13. In FIG. 15B, this ink interface is indicated by straight line (plane). However, its shape depends on a member forming the wall of the ejection orifice 13, and ink surface tensions and is usually a concave or convex curve (curved surface). The ink interface is indicated by straight line in order to simplify the drawing. In this state having meniscus, a thermoelectric conversion element (heater) serving as the energy generation element 15 is driven, and air bubbles are generated in ink by utilizing heat thus generated so that the ink can be discharged from the ejection orifice 13. In the present embodiment, an example using a heater as the energy generation element will be described. However, the present invention is not limited by this example, and, for example, various energy generation elements such as piezoelectric elements are applicable. In the present embodiment, the flow rate of ink that flows in the flow path 24 is, for example, approximately 0.1 to 100 mm/s, which can relatively decrease the influence of ejection operation with ink flowing on landing accuracy and the like.

As mentioned above, ink ejection operation is performed while the ink is circulated in the flow path between the ejection orifice and the printing element in the liquid ejection head. By such ink circulation, ink that has been thickened and has changed its coloring material concentration due to the evaporation of water and the like from the ink by heat resulting from ejection operation, heat caused by the temperature control of an element substrate, or heat from an external environment in the vicinity of the ejection orifice can be ejected, and the system can be replenished with fresh ink. As a result, increase in the proportion of the water-soluble organic solvent, in other words, elevation in the concentration of the water-soluble organic solvent, in the ink can be suppressed. Furthermore, ejection failure ascribable to ink thickening or image color irregularity ascribable to change in coloring material concentration can be suppressed. The proportion of the water-soluble organic solvent influences the agglomerating properties of ink solid matter by the reaction solution from the reaction solution application apparatus 3103. It is considered that the water-soluble organic solvent having a higher concentration blends well with solid matter supposed to form a strong agglomerate by the action of the reaction solution and thus hinders the agglomeration. Accordingly, reduction in agglomerating properties can probably be prevented by preventing increase in the proportion of the water-soluble organic solvent. As the degree of agglomeration of solid matter in the ink is increased, the solid matter in an ink image on the transfer body 3101 is more firmly fixed. As a result, the solid matter such as the coloring material is less likely to move to the liquid absorbing member 3105*a* even by contact with the liquid absorbing member 3105*a*. This permits proper removal of the liquid component of interest while a color component remains on the transfer body 3101. In addition, this also prevents insufficiently agglomerated solid matter such as coloring material and resin in the ink from clogging the pores of the porous body of the liquid absorbing member 3105*a* and is thus also effective for maintaining the liquid absorbing characteristics of the liquid absorbing member 3105*a* repetitively used. Moreover, this can also prevent an ink image from moving flowingly by pressing from the liquid absorbing member 3105*a* side. Thus, a high-quality image can be obtained. The liquid ejection apparatus 1000 which performs the ink circulation described above can be utilized not only in the transfer-type apparatus but in a direct drawing-type ink jet printing apparatus using liquid absorption apparatus 4005 which absorbs a liquid component as mentioned later. In the direct drawing-type ink jet printing apparatus as well, the ink circulation using the liquid ejection head 3 can increase the degree of agglomeration of solid matter in ink and can properly remove the liquid component of interest while a color component remains on a printing medium. This is also effective for maintaining the liquid absorbing characteristics of the liquid absorbing member repetitively used, and for suppressing the flowing movement of an ink image.

(Relationship Among P, W and H)

For the liquid ejection head of the present embodiment, the relationship among height H of the flow path 24, thickness P of the orifice plate (flow path forming member 12) and length (diameter) W of the ejection orifice is defined as described below.

In FIG. 15B, the upstream height of the flow path 24 at the lower end (communicating unit between an ejection orifice site and the flow path) of a portion corresponding to the orifice plate thickness P of the ejection orifice 13 (hereinafter, referred to as ejection orifice site 13*b*) is represented by H. The length of the ejection orifice site 13*b* is represented by P. The length of the ejection orifice site 13*b* in the liquid flow direction within the flow path 24 is represented by W. The liquid ejection head of the present embodiment has H of 3 to 30 μm, P of 3 to 30 μm and W of 6 to 30 μm. Ink is adjusted to a nonvolatile solvent concentration of 30%, a coloring material concentration of 3% and a viscosity of 0.002 to 0.003 Pa·s.

Figure 16A:
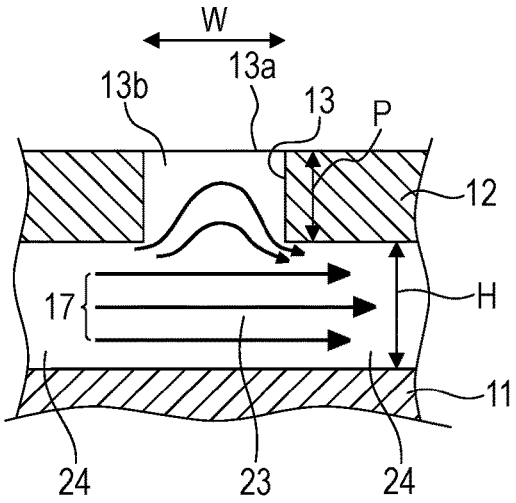
FIGS. 16A and 16B are schematic views illustrating an ink flow in the vicinity of an ejection orifice of a liquid ejection head.

In the present embodiment, ink thickening and the like ascribable to the evaporation of the ink from the ejection orifice 13 is suppressed as described below. FIG. 16A is a diagram illustrating the behavior of ink flow 17 in the ejection orifice 13, the ejection orifice site 13*b*, and the flow path 24 when the ink flow 17 within the flow path 24 and the pressure chamber 23 of the liquid ejection head (see FIGS. 15A to 15C) is in a steady state. In this drawing, the lengths of the arrows do not mean the magnitude of an ink flow rate. FIG. 16A illustrates the flow of ink that flows at a flow rate of $1.26\times10^{-4}$ ml/min into the flow path 24 from liquid supply path 18, in the liquid ejection head in which the height H of the flow path 24 is 14 μm, the length P of the ejection orifice site 13*b* is 10 μm, and the length (diameter) W of the ejection orifice is 17 μm.

In the present embodiment, the height H of the flow path 24, the length P of the ejection orifice site 13*b* and the length W in the ink flow direction of the ejection orifice site 13*b* have a relationship that satisfies the following expression (1):

$$H^{-0.34}\times P^{-0.66}\times W>1.5 \qquad \text{Expression (1)}$$

When the liquid ejection head of the present embodiment satisfies this condition, as illustrated in FIG. 16A, the ink flow 17 within the flow path 24 enters into the ejection orifice site 13*b*, arrives at a position of at least half the orifice plate thickness of the ejection orifice site 13*b*, and then returns to the flow path 24. The ink that has returned to the flow path 24 flows to the common recovery flow path 212 mentioned above via liquid recovery path 19. Specifically, at least a portion of the ink flow 17 arrives at a position of ½ or more of the ejection orifice site 13*b* in a direction from the pressure chamber 23 toward ink interface 13*a*, and then returns to the flow path 24. This flow can suppress ink thickening in many regions within the ejection orifice site 13*b*. The generation of such an ink flow within the liquid ejection head enables not only the ink of the flow path 24 but the ink of the ejection orifice site 13*b* to flow out to the flow path 24. As a result, ink thickening and increase in ink coloring material concentration can be further suppressed.

Figure 16B:
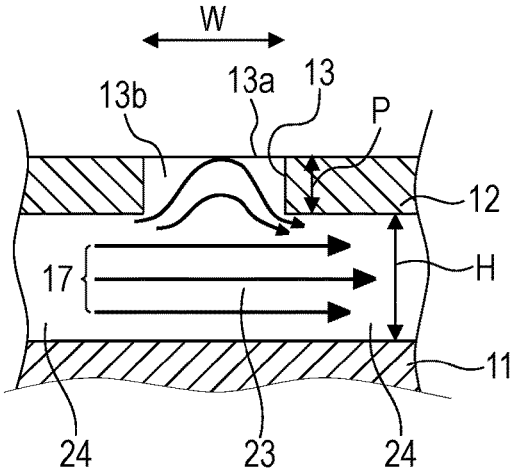

In the present embodiment, the influence of ink thickening and the like ascribable to the evaporation of the liquid from the ejection orifice can be further reduced as described below. FIG. 16B is a diagram illustrating the behavior of ink flow 17 in the ejection orifice 13, the ejection orifice site 13*b*, and the flow path 24 when the ink flow 17 within the liquid ejection head is in a steady state, as in FIG. 16A. In this drawing, the lengths of the arrows do not correspond to the magnitude of a flow rate and are indicated by given length, regardless of the magnitude of a flow rate. FIG. 16B illustrates the flow of ink that flows at a flow rate of $1.26\times10^{-4}$ ml/min into the flow path 24 from liquid supply path 18, in the liquid ejection head having H of 14 μm, P of 5 μm and W 12.4 μm.

In the present embodiment, the height H of the flow path 24, the length P of the ejection orifice site 13*b* and the length W in the ink flow direction of the ejection orifice site 13*b* have a relationship that satisfies the expression (2) mentioned later. This can further prevent ink having a changed coloring material concentration or an increased viscosity due to the evaporation of the ink from the ejection orifice from accumulating in the vicinity of the ink interface 13*a* of the ejection orifice site 13*b*, as compared with the first embodiment. Specifically, in the liquid ejection head of the present embodiment, as illustrated in FIG. 16B, the ink flow 17 within the flow path 24 enters into the ejection orifice site 13*b*, arrives at the vicinity of the ink interface 13*a* (meniscus position), and then returns to the flow path 24 through the ejection orifice site 13*b*. The ink that has returned to the flow path 24 flows to the common recovery flow path 212 mentioned above via liquid recovery path 19. Such an ink flow enables not only the ink within the ejection orifice site 13*b* susceptible to evaporation but the ink in the vicinity of the ink interface 13*a* particularly remarkably influenced by evaporation to flow out to the flow path 24 without accumulating in the inside of the ejection orifice site 13*b*. As a result, ink at a site particularly susceptible to the evaporation of water and the like from the ink, in the vicinity of the ejection orifice can flow out thereof without accumulation. Thus, ink thickening and increase in ink coloring material concentration can be suppressed. The present embodiment can suppress increase in viscosity in at least a portion of the ink interface 13*a* and can therefore further reduce the influence of change in ejection rate and the like on ejection, as compared with the case where viscosity is increased throughout the ink interface 13*a*.

The ink flow 17 of the present embodiment mentioned above has a velocity component of the ink flow direction (direction from the left toward the right in FIG. 16B) (hereinafter, this velocity component is referred to as a positive velocity component) within the flow path 24 at least in a central portion (central portion of the ejection orifice) in the vicinity of the ink interface 13*a*. In the present specification, the mode of ink flow 17 having a positive velocity component at least in the central portion in the vicinity of the ink interface 13*a* is referred to as "flow mode A". The mode of a flow having a negative velocity component of a direction opposite to that of the positive velocity component in the central portion of the ink interface 13*a* as mentioned later is referred to as "flow mode B".

Figure 17A:
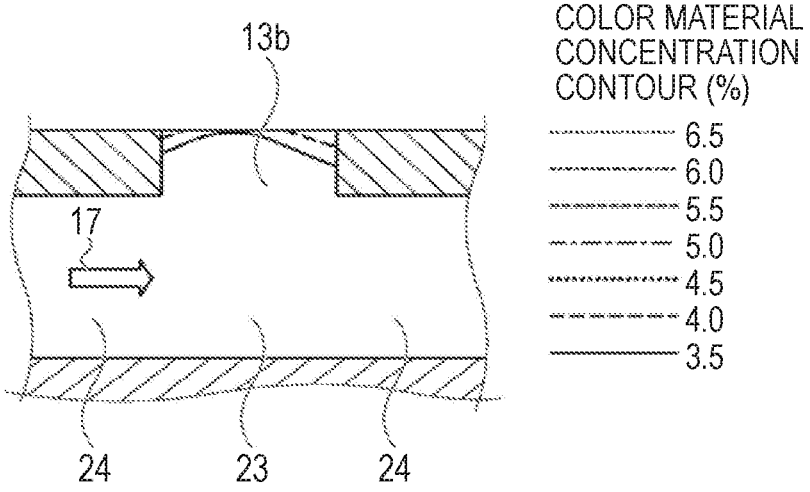
FIGS. 17A and 17B are diagrams illustrating the status of a coloring material concentration of ink within ejection orifice site 13*b*.
Figure 17B:
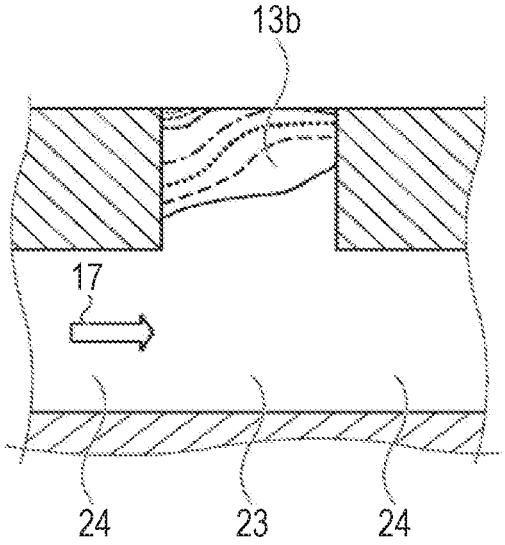

Each of FIGS. 17A and 17B is a diagram illustrating the status of a coloring material concentration of ink within ejection orifice site 13*b*. FIG. 17A illustrates the status of FIG. 16B, and FIG. 17B illustrates the status of Comparative Examples. Specifically, FIG. 17A illustrates the case of the flow mode A. FIG. 17B illustrates the case of the flow mode B according to Comparative Examples in which the flow in the vicinity of the central portion of the ink interface 13*a* within the ejection orifice site 13*b* has a negative velocity component as mentioned above. The contours illustrated in FIGS. 17A and 17B depict the distribution of coloring material concentrations in ink in the inside of the ejection orifice site 13*b*.

The flow mode B illustrated in FIG. 17B, as compared with the flow mode A illustrated in FIG. 17A, exhibits a higher coloring material concentration of ink in the inside of the ejection orifice site 13*b*. Specifically, in the flow mode A illustrated in FIG. 17A, the ink within the ejection orifice site 13*b* can be displaced (flow out) to the flow path 24 by the ink flow 17 reaching, with the positive velocity component, the vicinity of the ink interface 13*a*. This can suppress ink accumulation in the inside of the ejection orifice site 13*b*. As a result, elevation in coloring material concentration or viscosity can be further suppressed. Although both the flow modes A and B can suppress elevation in the concentration of the water-soluble organic solvent in the ink, the flow mode A is more effective.

Figure 18:
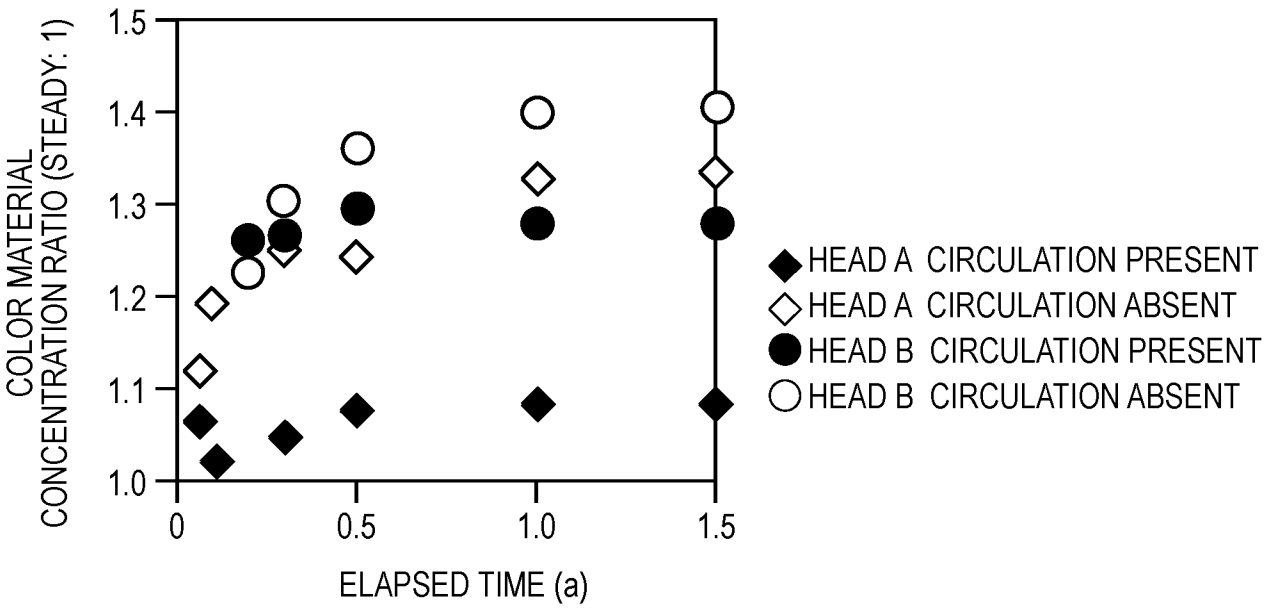
FIG. 18 is a diagram illustrating the comparison of a coloring material concentration of ink discharged from each liquid ejection head (Head) producing flow mode A or B.

FIG. 18 is a diagram illustrating the comparison of a coloring material concentration of ink discharged from each of the liquid ejection head producing the flow mode A (head A) and the liquid ejection head producing the flow mode B (head B). This drawing illustrates data obtained on each of the head A and the head B when ink is discharged in the presence of the ink flow 17 in the flow path 24 and when ink is discharged in the absence of an ink flow within the flow path without generating the ink flow 17. In this drawing, the abscissa depicts an elapsed time after ink discharge from the ejection orifice, and the ordinate depicts the coloring material concentration ratios of dots formed by the discharged ink on a printing medium. This concentration ratio is the ratio of the concentration of a dot formed by ink discharged after each elapsed time, when the concentration of a dot formed by ink discharged at an ink ejecting frequency of 100 Hz is defined as 1.

As illustrated in FIG. 18, the concentration ratio at an elapsed time of 1 second or more is 1.3 or more for both the heads A and B without the ink flow 17 (Circulation absent). Thus, the coloring material concentration of the ink becomes high relatively early. When the ink flow 17 is produced in the head B, the concentration ratio falls within a range up to approximately 1.3. Thus, the head B in the presence of the ink flow can further suppress increase in coloring material concentration as compared with in the absence of the ink flow. However, ink having a coloring material concentration increased to a concentration ratio up to 1.3 accumulates in the ejection orifice site. By contrast, when the ink flow is produced in the head A, the coloring material concentration ratio falls within a range of 1.1 or less. Studies have revealed that color irregularity is difficult to visually identify, provided that change in coloring material concentration is approximately 1.2 or less. Specifically, the head A can suppress change in coloring material concentration that causes visually identifiable color irregularity even at an elapsed time of approximately 1.5 seconds, and is therefore more preferable than the head B. FIG. 18 illustrates the case where the coloring material concentration is increased with evaporation. If the coloring material concentration is decreased with evaporation, the liquid ejection head of the present embodiment can also suppress the change in coloring material concentration. When the ink contains a resin in addition to the coloring material, the ink circulation can be controlled such that change in the concentration of the solid matter is 1.2 or less times an initial value.

The studies of the present inventors have revealed that for the liquid ejection head producing the flow mode A according to the present embodiment, the relationship among the height H of the flow path 24, the thickness P of the orifice plate (flow path forming member 12) and the length (diameter) W of the ejection orifice satisfies the following expression (2):

$$H^{-0.34} \times P^{-0.66} \times W > 1.7 \qquad \text{Expression (2)}$$

Hereinafter, the left-hand value of the expression (2) is referred to as determination value J. The studies of the present inventors have revealed that the liquid ejection head that satisfies the expression (2) produces the flow mode A as illustrated in FIG. 16B, whereas the liquid ejection head producing the flow mode B does not satisfy the relational expression (2).

Hereinafter, the expression (2) will be described.

Figure 19:
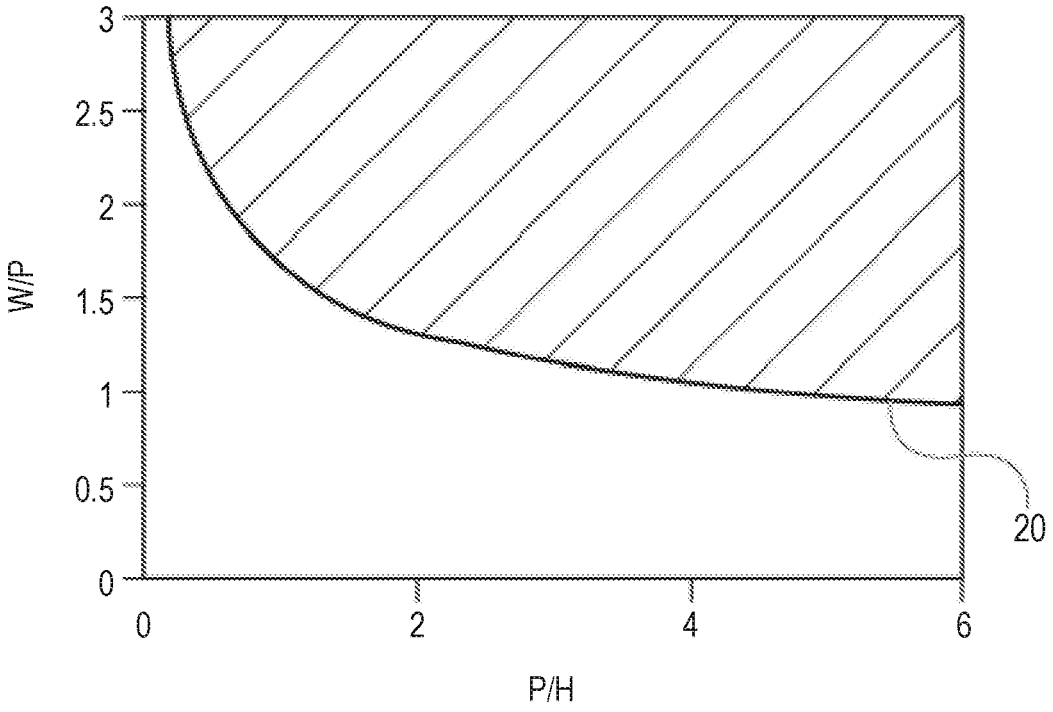
FIG. 19 is a diagram illustrating the relationship of a liquid ejection head producing flow mode A in the second embodiment with a comparative liquid ejection head producing flow mode B.

FIG. 19 is a diagram illustrating the relationship of the liquid ejection head producing the flow mode A in the second embodiment with the comparative liquid ejection head producing the flow mode B. The abscissa of FIG. 19 depicts the ratio of P to H (P/H), and the ordinate of FIG. 19 depicts the ratio of W to P (W/P). Threshold line 20 is a line that satisfies the following expression (3):

$$(W/P) = 1.7 \times (P/H)^{-0.34} \qquad \text{Expression (3)}$$

In FIG. 19, a liquid ejection head having the relationship among H, P and W in a shaded area above the threshold line 20 produces the flow mode A, and a liquid ejection head having this relationship in an area below the threshold line 20 (including the threshold line 20 itself) produces the flow mode B. Specifically, a liquid ejection head that satisfies the following expression (4) produces the flow mode A:

$$(W/P) > 1.7 \times (P/H)^{-0.34} \qquad \text{Expression (4)}$$

Since the expression (4) is laid out as the expression (2), a head having the relationship among H, P and W that satisfies the relational expression (2) (head having determination value J larger than 1.7) produces the flow mode A.

The relationship described above will be further described with reference to FIGS. 20A to 20D and 21. Each of FIGS. 20A to 20D is a diagram illustrating the behavior of ink flow 17 in the vicinity of ejection orifice site 13*b* in the liquid ejection head having the area above or below the threshold line 20 illustrated in FIG. 19. FIG. 21 is a diagram illustrating flow mode A or flow mode B as flows derived from liquid ejection heads having various shapes. In FIG. 21, the filled circles depict the liquid ejection heads producing the flow mode A, and the X-marks depict the liquid ejection heads producing the flow mode B.

Figure 20A:
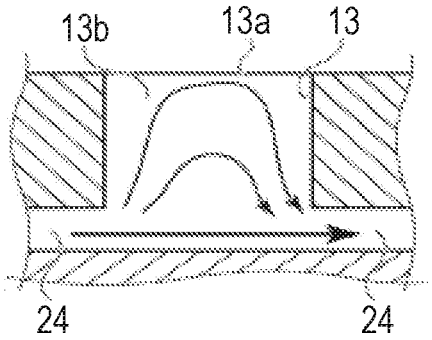
FIGS. 20A, 20B, 20C and 20D are diagrams illustrating the behavior of ink flow 17 in the vicinity of ejection orifice site 13*b* in a liquid ejection head having areas above and below threshold line 20 illustrated in FIG. 19.
Figure 21:
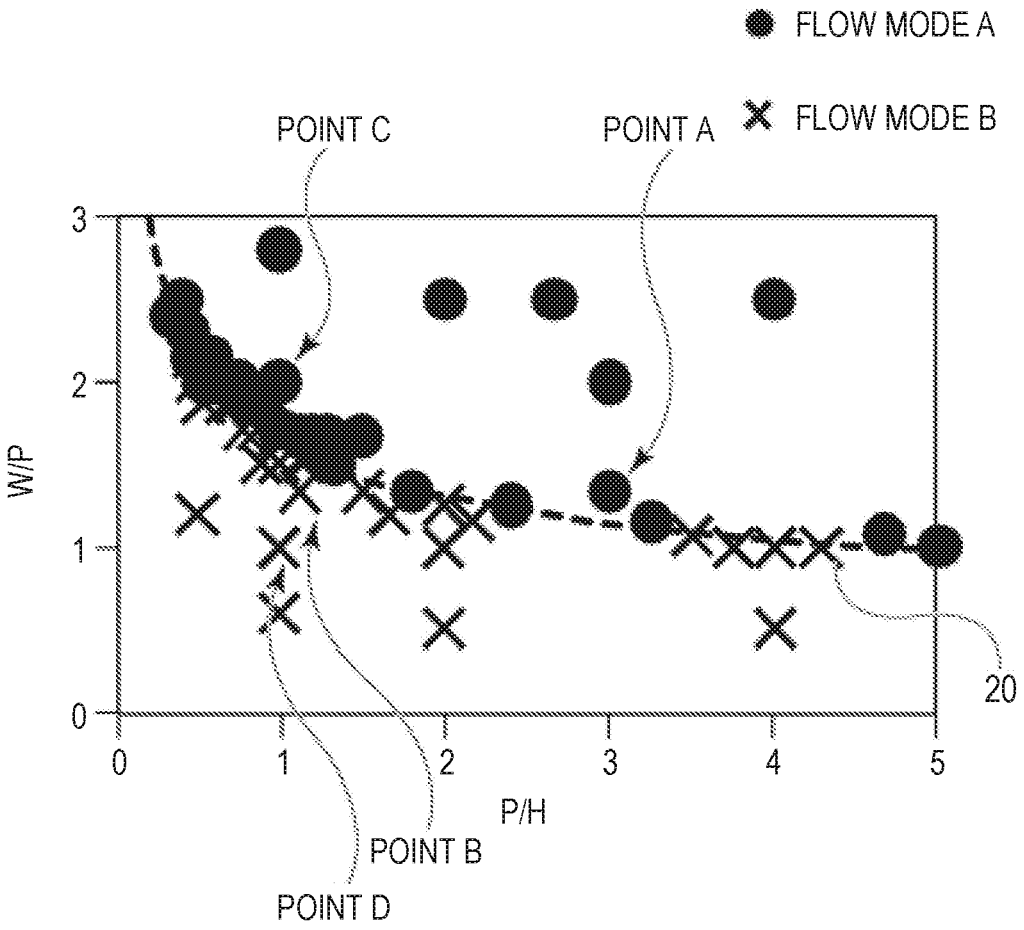
FIG. 21 is a diagram illustrating flow mode A or flow mode B as flows derived from liquid ejection heads having various shapes.

FIG. 20A illustrates an ink flow in a liquid ejection head having a shape with H of 3 μm, P of 9 μm and W of 12 μm and having determination value J of 1.93 which is larger than 1.7. Specifically, the example illustrated in FIG. 20A has the flow mode A. This head corresponds to point A in FIG. 21.

Figure 20B:
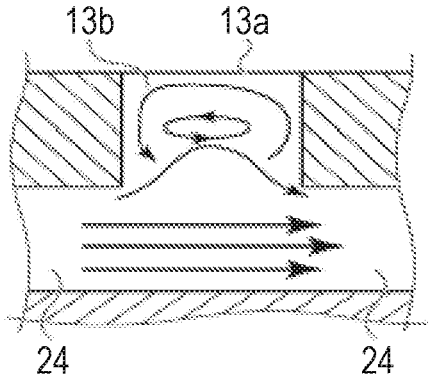

FIG. 20B illustrates an ink flow in a liquid ejection head having a shape with H of 8 μm, P of 9 μm and W of 12 μm and having a determination value of 1.39 which is smaller than 1.7. Specifically, this flow has the flow mode B. This head corresponds to point B in FIG. 21.

Figure 20C:
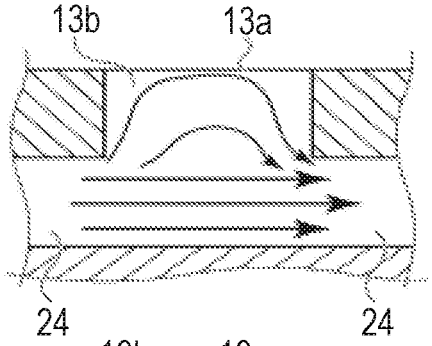

FIG. 20C illustrates an ink flow in a liquid ejection head having a shape with H of 6 μm, P of 6 μm and W of 12 μm and having a determination value of 2.0 which is larger than 1.7. Specifically, this flow has the flow mode A. This head corresponds to point C in FIG. 21.

Figure 20D:
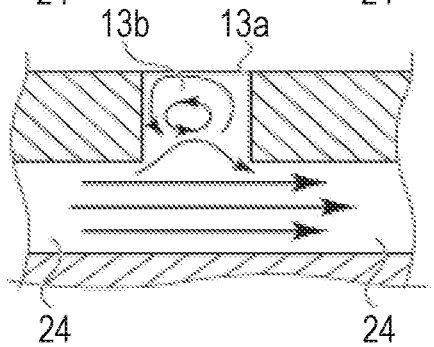

Finally, FIG. 20D illustrates an ink flow in a liquid ejection head having a shape with H of 6 μm, P of 6 μm and W of 6 μm and having a determination value of 1.0 which is smaller than 1.7. Specifically, this flow has the flow mode B. This head corresponds to point D in FIG. 21.

As described above, the threshold line 20 of FIG. 19 can preferably be used to discriminate between the liquid ejection head producing the flow mode A and the liquid ejection head producing the flow mode B. Specifically, a liquid ejection head having determination value J larger than 1.7 in the expression (2) produces the flow mode A, and its ink flow 17 has a positive velocity component at least in the central portion of the ink interface 13*a*.

Next, the comparison between the ejection rates of ink droplets respectively ejected from the liquid ejection head producing the flow mode A (head A) and the liquid ejection head producing the flow mode B (head B) will be described.

Figure 22A:
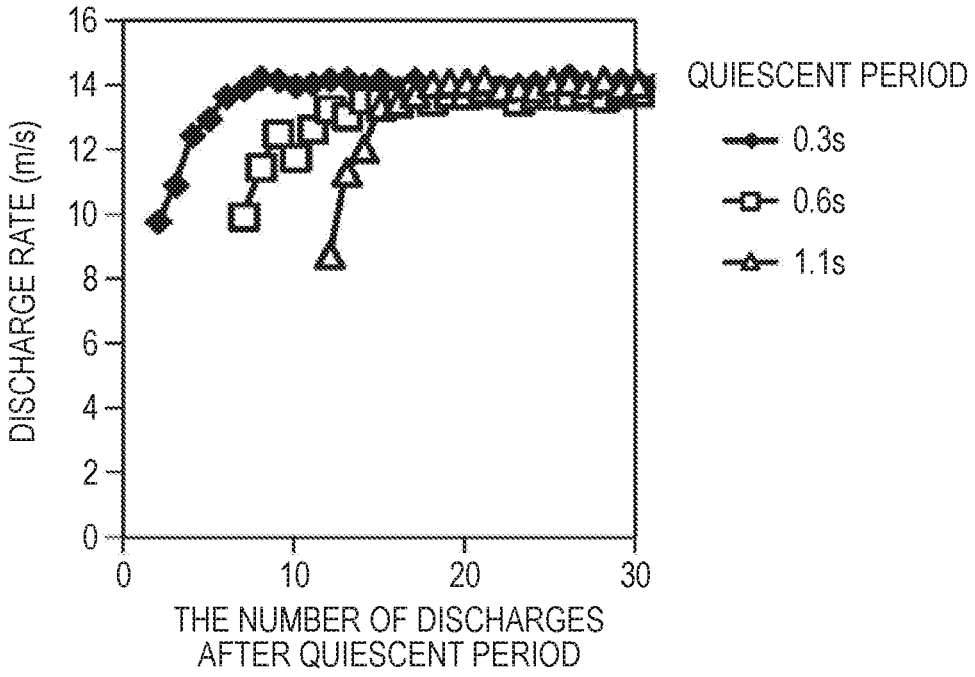
FIGS. 22A and 22B are diagrams illustrating the relationship between the number of ejections (the number of times ink is discharged) and an ejection rate, after quiescence for a given period after ejection from a liquid ejection head of each flow mode.
Figure 22B:
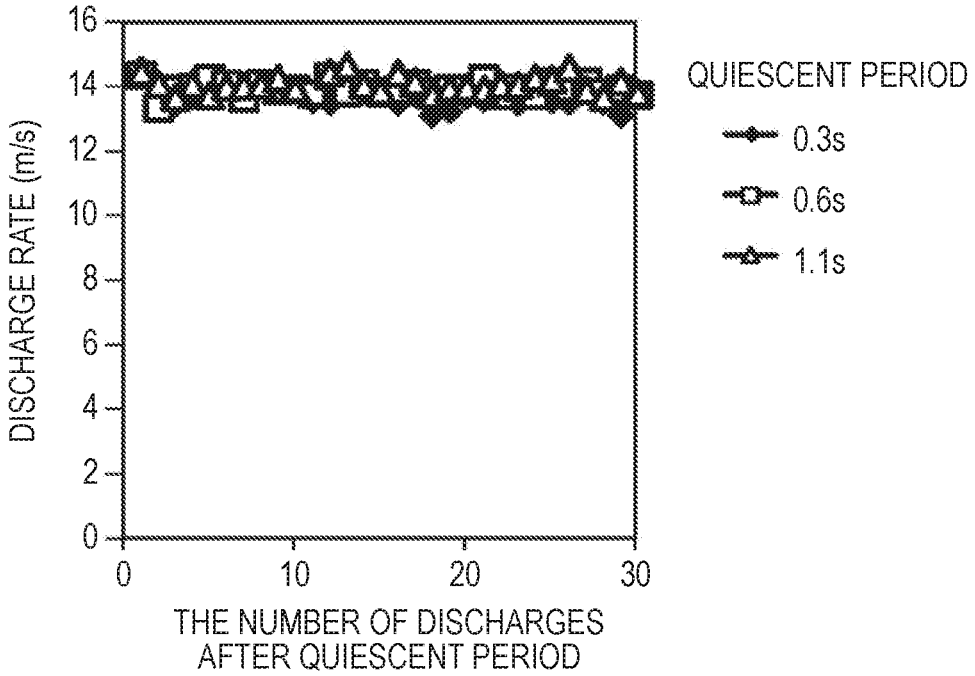

Each of FIGS. 22A and 22B is a diagram illustrating the relationship between the number of ejections (the number of times ink is ejected) and an ejection rate, after quiescence for a given period after ejection from the liquid ejection head of each flow mode.

FIG. 22A illustrates the relationship between the number of ejections and an ejection rate when pigment ink containing 20% by mass or more of solid matter that exhibits an ink viscosity of approximately 4 cP at an ejection temperature is ejected using the head B. As illustrated in the drawing, even in the presence of the ink flow 17, the ejection rate is reduced up to the 20th ejection, depending on a quiescent period. FIG. 22B illustrates the relationship between the number of ejections and an ejection rate when the same pigment ink as that of FIG. 22A is ejected using the head A. The ejection rate is not reduced even at the first ejection after quiescence. This experiment employed ink containing 20% by mass or more of solid matter. However, the concentration does not limit the scope of the present invention. In general, the mode A is evidently effective when ink having a solid matter content of 8% by mass or more (8 wt % or more) is ejected, though varying depending on the dispersibility of the solid matter in the ink.

As described above, the head producing the flow mode A can further suppress reduction in the ejection rate of ink droplets even for ink that tends to reduce its ejection rate due to ink thickening ascribable to the evaporation of the ink from the ejection orifice.

Whether to be the flow mode A or the flow mode B of the ink flow 17 within the ejection orifice is dominantly influenced by the relationship among P, W and H associated with the shape of the flow path and the like as mentioned above in a normal environment. Conditions other than these conditions, for example, the flow rate of the ink flow 17, the viscosity of the ink and the width of the ejection orifice 13 in a direction perpendicular to the flow direction of the ink flow 17 (length of the ejection orifice in a direction orthogonal to W) have very small influence thereon, as compared with P, W and H. Thus, the flow rate or the viscosity of the ink can be appropriately set according to the required specification of the liquid ejection head (ink jet printing apparatus) or the environmental conditions used. For example, the flow rate of the ink flow 17 in the flow path 24 is 0.1 to 100 mm/s, and ink having a viscosity of 30 cP or less at an ejection temperature is applicable. When the amount of the ink evaporated from the ejection orifice is largely increased by environmental change and the like in use, the flow mode A can be established by appropriately increasing the flow rate of the ink flow 17. The liquid ejection head of the flow mode B does not produce the flow mode A if the flow rate is maximized. Specifically, whether to be the mode A or the flow mode B is dominated by the relationship among H, P and W associated with the shape of the liquid ejection head mentioned above, not by the flow rate or viscosity conditions of the ink. Among various liquid ejection heads producing the flow mode A, particularly, a liquid ejection head having H of 20 μm or less, P of 20 μm or less and W of 30 μm or less is capable of higher-definition printing.

As described above, in the liquid ejection head producing the flow mode A, the ink within the ejection orifice site 13*b*, particularly, the ink in the vicinity of the ink interface, can flow out to the flow path 24 by the ink flow 17 reaching, with the positive velocity component, the vicinity of the ink interface 13*a*. Accordingly, ink accumulation in the inside of the ejection orifice site 13*b* can be suppressed. As a result, for example, elevation in the coloring material concentration of the ink within the ejection orifice site can also be suppressed against the evaporation of the ink from the ejection orifice. In the present embodiment, as mentioned above, ink ejection operation is performed while the ink flows within the flow path 24. Therefore, the ink is ejected in the presence of an ink flow that enters into the ejection orifice site 13*b* from the flow path 24 (pressure chamber 23), arrives at the ink interface, and then returns to the ink flow path. As a result, elevation in coloring material concentration in the inside of the ejection orifice site 13*b* is suppressed at all times even in a quiescent operating state of printing. Therefore, the first ejection after the quiescent printing operation can be favorably performed, and the occurrence of color irregularity and the like can be reduced.

As described above, in the present embodiment, the ink circulation can be performed at least during application of the ink and may be performed before the start of printing operation or continuously after the completion of printing operation.

<Printing Medium and Printing Medium Conveyance Apparatus>

In the present embodiment, the printing medium 3108 is not particularly limited, and any printing medium known in the art can preferably be used. Examples of the printing medium include long materials wound into a roll shape and sheets cut into a predetermined dimension. Examples of the material include paper, plastic films, wooden boards, cardboards and metal films.

In FIG. 1, the printing medium conveyance apparatus 3107 for conveying the printing medium 3108 is constituted by printing medium feeding roller 3107*a* and printing medium winding roller 3107*b*. However, the printing medium conveyance apparatus 3107 is not particularly limited by this configuration as long as the printing medium conveyance apparatus 3107 can convey the printing medium.

<Control System>

Figure 3:
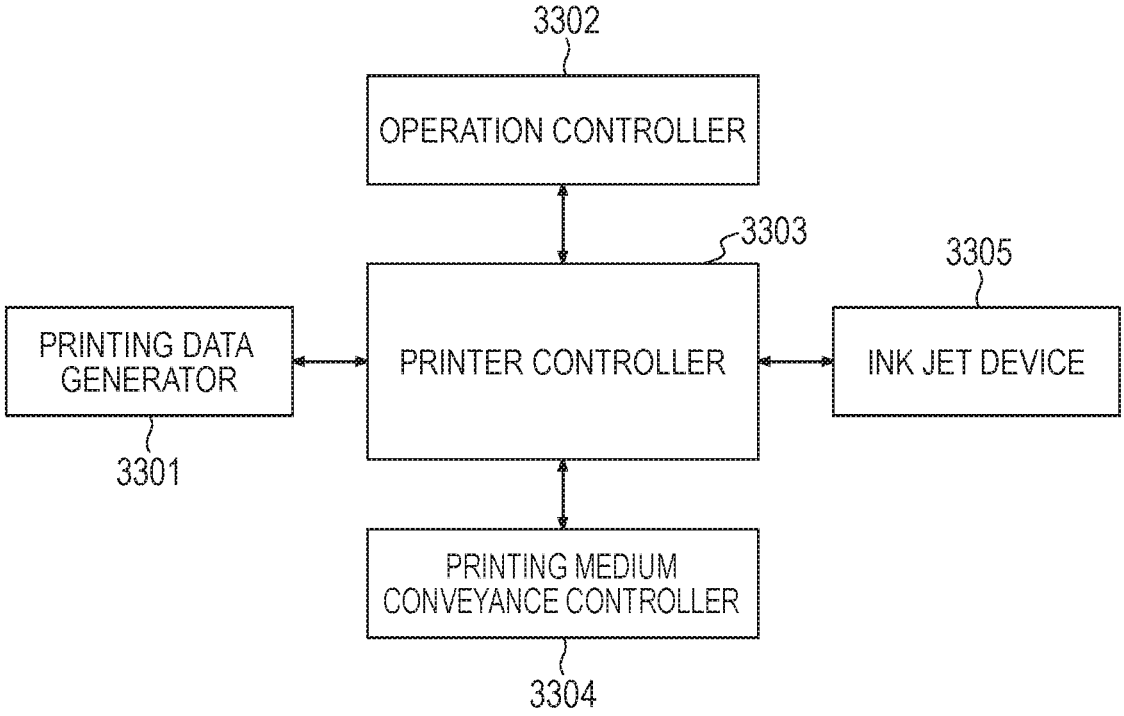
FIG. 3 is a block diagram illustrating a control system of the whole apparatus for the ink jet printing apparatus illustrated in FIG. 1, FIG. 2 or FIG. 24.

The transfer-type ink jet printing apparatus according to the present embodiment has a control system which controls each apparatus. FIG. 3 is a block diagram illustrating a control system of the whole apparatus for the transfer-type ink jet printing apparatus illustrated in FIG. 1.

In FIG. 3, reference numeral 3301 denotes a printing data generator such as an external print server. Reference numeral 3302 denotes an operation controller such as an operating panel. Reference numeral 3303 denotes a printer controller for executing a printing process. Reference numeral 3304 denotes a printing medium conveyance controller for conveying the printing medium. Reference numeral 3305 denotes an ink jet device for printing and corresponds to the ink application apparatus 3104 of FIG. 1.

Figure 4:
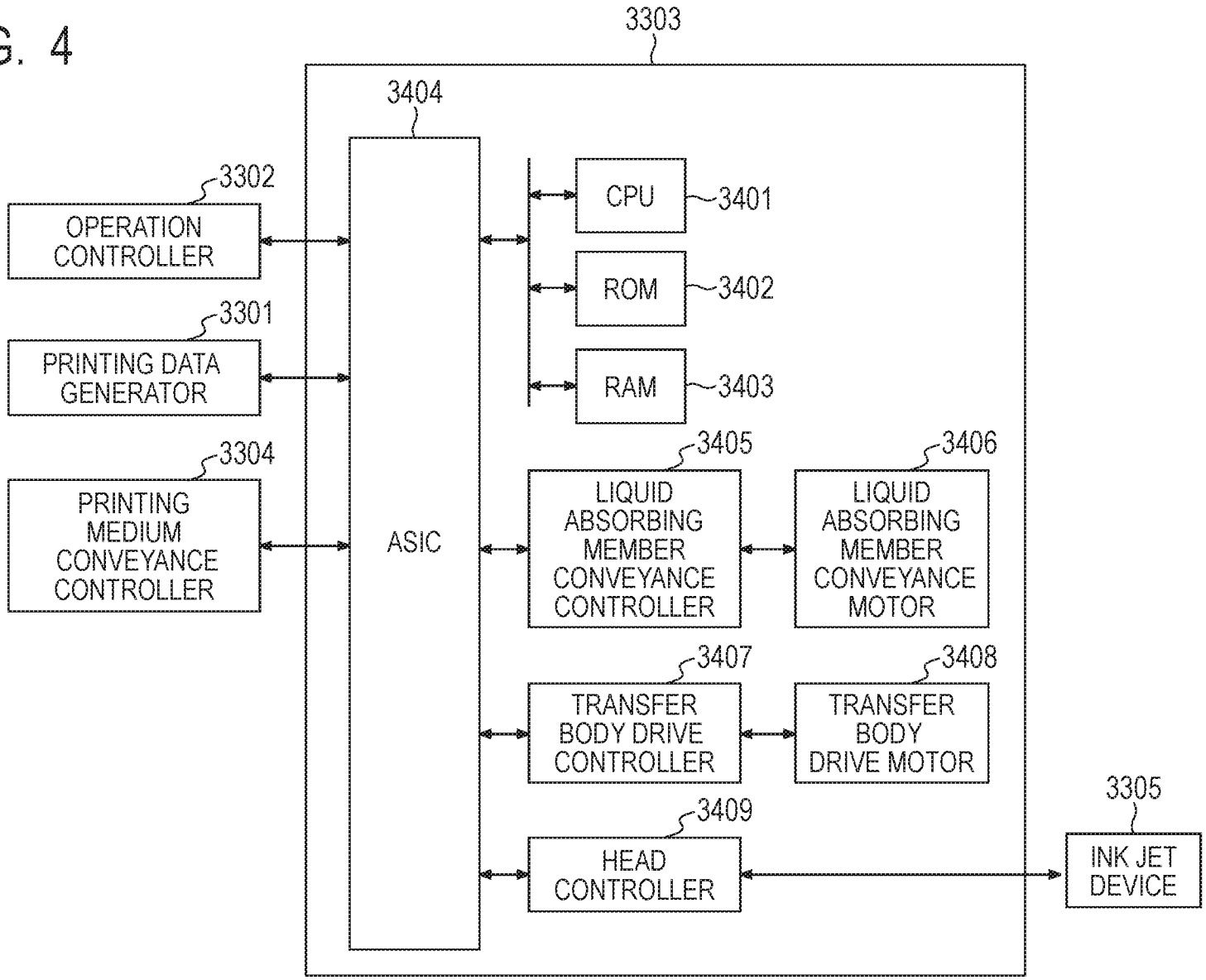
FIG. 4 is a block diagram of a printer controller in the transfer-type ink jet printing apparatus illustrated in FIG. 1.

FIG. 4 is a block diagram of a printer controller in the transfer-type ink jet printing apparatus of FIG. 1.

Reference numeral 3401 denotes CPU which controls the whole printer. Reference numeral 3402 denotes ROM which stores the control program of the CPU 3401. Reference numeral 3403 denotes RAM for executing the program. Reference numeral 3404 denotes an application specific integrated circuit (ASIC) having an embedded network controller, serial IF controller, controller for head data generation, motor controller and the like. Reference numeral 3405 denotes a liquid absorbing member conveyance controller for driving liquid absorbing member conveyance motor 3406. The liquid absorbing member conveyance controller is command-controlled from the ASIC 3404 via serial IF. Reference numeral 3407 denotes a transfer body drive controller for driving transfer body drive motor 3408. The transfer body drive controller is also command-controlled from the ASIC 3404 via serial IF. Reference numeral 3409 denotes a head controller which performs the final ejection data generation, driving voltage generation and the like of the ink jet device 3305.

The transfer-type ink jet printing apparatus mentioned above is described by taking a form including the liquid absorption apparatus 3105 as an example. The ink circulation by the liquid ejection head is also effective for a transfer-type ink jet printing apparatus lacking the liquid absorption apparatus 3105. This is because an ink image on the transfer body 3101 is integrally transferred to the printing medium and can be prevented from partially remaining in the transfer body 3101, by increasing the degree of agglomeration of solid matter in the ink. The high degree of agglomeration is obtained by the ink circulation as mentioned above. The ink circulation can render so-called "parting transfer" less likely to occur.

(Direct Drawing-Type Ink Jet Printing Apparatus)

Another example of the present embodiment includes a direct drawing-type ink jet printing apparatus. In the direct drawing-type ink jet printing apparatus, the discharge receiving medium is a printing medium on which an image is to be formed.

Figure 24:
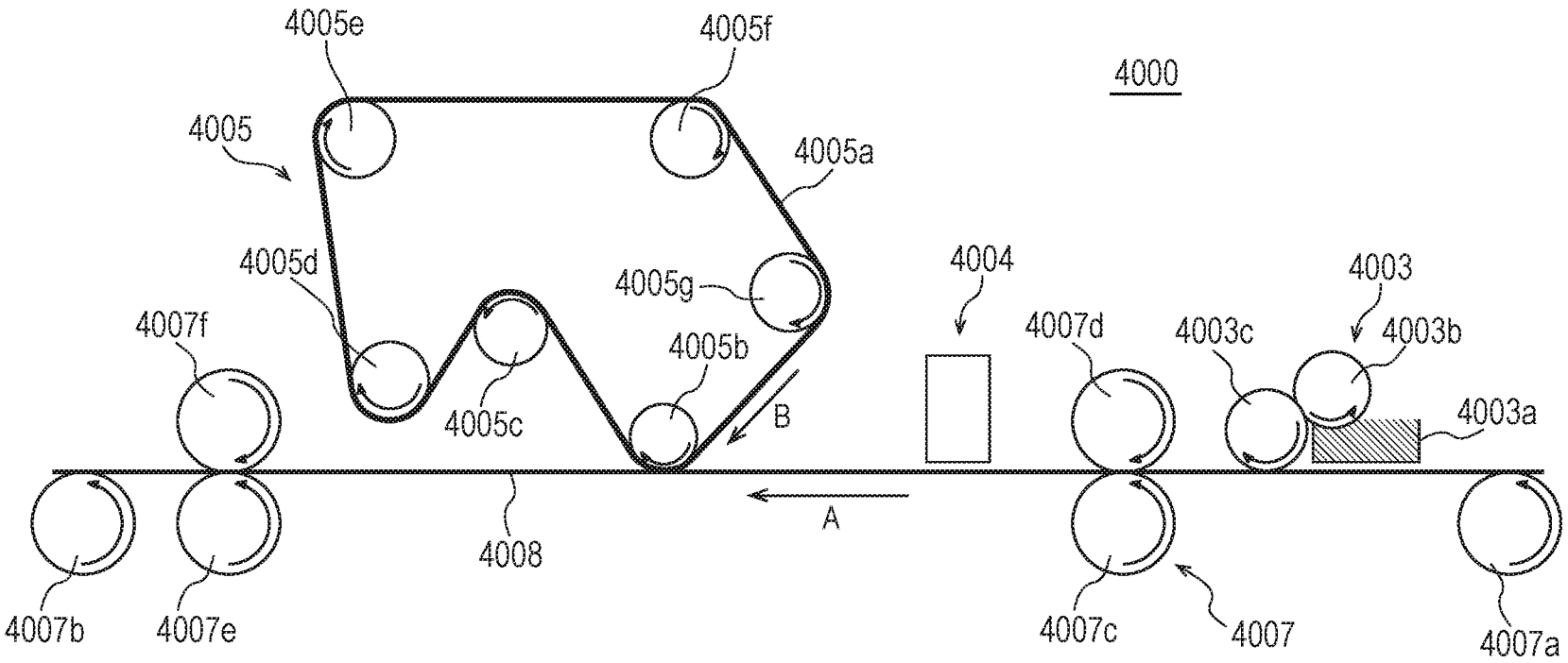
FIG. 24 is a schematic view illustrating one example of the configuration of a direct drawing-type ink jet printing apparatus according to one embodiment of the present invention.

FIG. 24 is a schematic view illustrating one example of the configuration outline of direct drawing-type ink jet printing apparatus 4000 according to the present embodiment. The direct drawing-type ink jet printing apparatus compared with the transfer-type ink jet printing apparatus mentioned above is similar in unit to the transfer-type ink jet printing apparatus except that the direct drawing-type ink jet printing apparatus lacks the transfer body 3101, the supporting member 3102 and the transfer body cleaning member 3109 and forms an image on printing medium 4008.

Thus, reaction solution application apparatus 4003 which applies a reaction solution to the printing medium 4008, ink application apparatus 4004 which applies ink to the printing medium 4008, and liquid absorption apparatus 4005 which absorbs a liquid component contained in an ink image on the printing medium 4008 by the contact of liquid absorbing member 4005*a* with the ink image are configurationally similar to those in the transfer-type ink jet printing apparatus, so that the description is omitted.

In the direct drawing-type ink jet printing apparatus of the present embodiment, the liquid absorption apparatus 4005 has liquid absorbing member 4005*a* and pressing member 4005*b* for liquid absorption which presses the liquid absorbing member 4005*a* against an ink image on the printing medium 4008. The shapes of the liquid absorbing member 4005*a* and the pressing member 4005*b* are not particularly limited and can be similar to the shapes of the liquid absorbing member and the pressing member that can preferably be used in the transfer-type ink jet printing apparatus. The liquid absorption apparatus 4005 may also have a tension member which tensions the liquid absorbing member. In FIG. 24, reference numerals 4005*c*, 4005*d*, 4005*e*, 4005*f* and 4005*g* denote tension rollers as the tension member. The number of tension rollers is not limited to 5 in FIG. 4, and a necessary number of tension rollers can be disposed according to apparatus design. A printing medium supporting member (not shown) which supports the printing medium from below may be disposed in an ink applying unit which applies ink to the printing medium 4008 by the ink application apparatus 4004, and a liquid component removing unit which removes a liquid component by the contact of the liquid absorbing member 4005*a* with an ink image on the printing medium.

<Printing Medium Conveyance Apparatus>

In the direct drawing-type ink jet printing apparatus of the present embodiment, printing medium conveyance apparatus 4007 is not particularly limited, and a conveyance unit in a direct drawing-type ink jet printing apparatus known in the art can preferably be used. Examples thereof include a printing medium conveyance apparatus having printing medium feeding roller 4007*a*, printing medium winding roller 4007*b* and printing medium conveyance rollers 4007*c*, 4007*d*, 4007*e* and 4007*f*, as illustrated in FIG. 24.

<Control System>

The direct drawing-type ink jet printing apparatus according to the present embodiment has a control system which controls each apparatus. A block diagram illustrating a control system of the whole apparatus for the direct drawing-type ink jet printing apparatus illustrated in FIG. 24 is as illustrated in FIG. 3, as in the transfer-type ink jet printing apparatus illustrated in FIG. 1.

Figure 25:
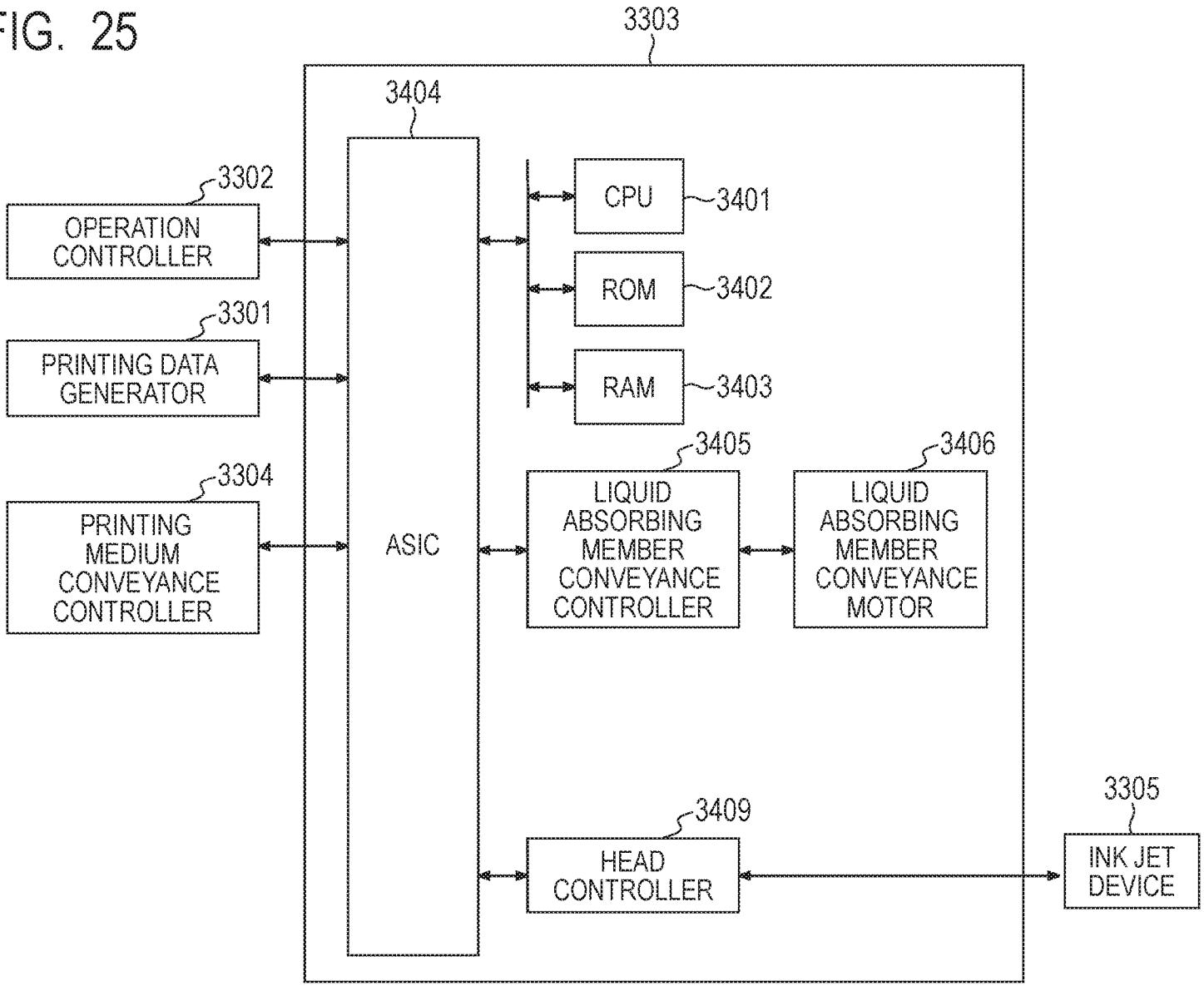
FIG. 25 is a block diagram of a printer controller in the direct drawing-type ink jet printing apparatus illustrated in FIG. 24.

FIG. 25 is a block diagram of a printer controller in the direct drawing-type ink jet printing apparatus of FIG. 24. This block diagram is equivalent to the block diagram of the printer controller in the transfer-type ink jet printing apparatus in FIG. 4 except that the transfer body drive controller 3407 and the transfer body drive motor 3408 are absent.

EXAMPLES

Hereinafter, the present invention will be described in more detail with reference to Examples and Comparative Examples. The present invention is not limited by Examples described below by any means without departing from the spirit of the present invention. In the description of Examples below, the term "part" is based on mass unless otherwise described.

Examples

In the present Examples, the transfer-type ink jet printing apparatus illustrated in FIG. 1 was used.

<Transfer Body>

In the present Examples, the transfer body 3101 was fixed to the supporting member 3102 using an adhesive. In the present Examples, a PET sheet of 0.5 mm in thickness coated with silicone rubber (KE12 manufactured by Shin-Etsu Chemical Co., Ltd.) at a thickness of 0.3 mm was used as the elastic layer of the transfer body. Glycidoxypropyltriethoxysilane and methyltriethoxysilane were mixed at a molar ratio of 1:1 and heated to reflux, and a mixture of the resulting condensate with a photo cation polymerization initiator (SP150 manufactured by ADEKA Corp.) was further prepared. The elastic layer surface was subjected to atmospheric pressure plasma treatment so as to attain a contact angle of 10 degrees or less for water. The mixture was applied onto the elastic layer. Then, a film was formed by UV irradiation (high-pressure mercury lamp, integrated light exposure: 5000 mJ/cm$^2$) and thermal curing (150° C., 2 hr) to prepare transfer body 3101 having a surface layer of 0.5 μm in thickness on the elastic body.

In this configuration, a double-faced tape for retaining the transfer body 3101 was used between the transfer body 3101 and the supporting member 3102, though not shown in order to simplify the description.

<Reaction Solution Applying Unit>

The reaction solution to be applied by the reaction solution application apparatus 3103 had the following composition, and the amount of the reaction solution applied was set to 1 g/m$^2$.

Reaction Solution 1

Citric acid: 30.0 parts

Potassium hydroxide: 3.5 parts

Glycerin: 5.0 parts

Surfactant (product name: Megafac F444, manufactured by DIC Corp.): 3.0 parts

Ion-exchange water: balance

<Ink Applying Unit>

The ink was prepared as described below.

(Preparation of Pigment Dispersion)

10 parts of carbon black (product name: MONARCH 1100, manufactured by Cabot Corp.), 15 parts of an aqueous resin solution (styrene-ethyl acrylate-acrylic acid copolymer, acid number: 150, weight-average molecular weight (Mw): 8,000; an aqueous solution having a resin content of 20.0% by mass was neutralized with an aqueous potassium hydroxide solution) and 75 parts of pure water were mixed and added to a batch-type vertical sand mill (manufactured by AIMEX Corp.), which was then packed with 200 parts of zirconia beads having a diameter of 0.3 mm. Dispersion treatment was performed for 5 hours under water cooling. This dispersion was centrifuged, and coarse particles were removed to obtain a black pigment dispersion having a pigment content of 10.0% by mass.

(Preparation of Resin Particle Dispersion)

20 parts of ethyl methacrylate and 2 parts of 2,2'-azobis-(2-methylbutyronitrile) were mixed and stirred for 0.5 hours. This mixture was added dropwise to 78 parts of an aqueous solution of 3% polyoxyethylene alkyl ether (product name: NIKKOL BC15, manufactured by Nikko Chemicals Co., Ltd.), and the mixture was stirred for 0.5 hours. Then, the mixture was irradiated with ultrasound for 3 hours in an ultrasound irradiation machine. Subsequently, polymerization reaction was performed at 80° C. for 4 hours in a nitrogen atmosphere to obtain a resin particle dispersion containing 25% of solid matter. The obtained resin particle had a volume-average particle size of 200 nm. Tg was 60° C.

(Preparation of Ink)

The resin particle dispersion and the pigment dispersion obtained as described above were mixed with each component described below. The balance of ion-exchange water refers to an amount that attains 100.0% by mass in total of all components constituting the ink.

Ink 1

Pigment dispersion (coloring material content: 10.0% by mass): 40.0% by mass

Resin particle dispersion: 20.0% by mass

Glycerin: 3.0% by mass

Polyethylene glycol (number-average molecular weight (Mn): 1,000): 2.0% by mass

Surfactant: (product name: ACETYLENOL E100, manufactured by Kawaken Fine Chemicals Co., Ltd.): 0.5% by mass Ion-exchange water: balance This mixture was thoroughly stirred and dispersed, and then pressure-filtered through a microfilter (manufactured by FUJIFILM Corp.) having a pore size of 3.0 μm to prepare black ink.

Ink 2

Pigment dispersion (coloring material content: 10.0% by mass): 40.0% by mass

Resin particle dispersion: 20.0% by mass

Glycerin: 7.0% by mass

Polyethylene glycol (number-average molecular weight (Mn): 1,000): 3.0% by mass

Surfactant: (product name: ACETYLENOL E100, manufactured by Kawaken Fine Chemicals Co., Ltd.): 0.5% by mass Ion-exchange water: balance This mixture was thoroughly stirred and dispersed, and then pressure-filtered through a microfilter (manufactured by FUJIFILM Corp.) having a pore size of 3.0 μm to prepare black ink.

(Ink Application Apparatus)

An ink jet device having an ink jet head of type to discharge ink by an on-demand system using a thermoelectric conversion element was used as the ink application apparatus 3104.

(Liquid Ejection Head)

The liquid ejection head used had a structure having the configuration in the vicinity of the ejection orifice as illustrated in FIGS. 15A to 15C.

A value calculated from the height H of the flow path 24, the length P of the ejection orifice site 13*b* and the length W in the ink flow direction of the ejection orifice site 13*b* according to the following expression was defined as a determination value.

$$\text{Determination value}(J)=H^{-}0.34\times P^{-0.66}\times W$$

The ink circulation was adjusted such that the ink flowed at $1.26\times10^{-4}$ ml/min into the flow path 24 of the liquid ejection head from the liquid supply path 18.

Liquid Ejection Head 1

H=14 μm, P=10 μm, W=17 μm

Determination value=1.52

Liquid Ejection Head 2

H=14 μm, P=5 μm, W=12.4 μm

Determination value=1.75

(Liquid Absorbing Unit)

The liquid absorbing member 3105*a* is adjusted by the conveyance rollers 3105*c*, 3105*d* and 3105*e* which convey the liquid absorbing member while tensioning the liquid absorbing member such that the liquid absorbing member 3105*a* moves at a speed equivalent to the movement speed of the transfer body 3101. The printing medium 3108 is conveyed by the printing medium feeding roller 3107*a* and the printing medium winding roller 3107*b* such that the printing medium 3108 moves at a speed equivalent to the movement speed of the transfer body 3101.

(Liquid Absorbing Member)

Porous PTFE having an average pore size of 0.2 μm was used in the liquid absorbing member. This absorbing member had a Gurley value of 8 seconds. This liquid absorbing member was infiltrated by dipping with a treatment solution consisting of 95 parts of ethanol and 5 parts of water. Then, the treatment solution was replaced with a solution consisting of 100 parts of water. The resulting liquid absorbing member was used in liquid removal. Pressing member 3105*b* having a roller diameter of ϕ200 mm was used in the liquid absorption unit.

(Heating Unit and Transfer Unit)

The heating apparatus 3010 was configured such that a plurality of radiation heating sources each having a halogen lamp and a reflecting mirror as a pair were arranged in the rotation direction of the transfer body 3101. The halogen lamp and the reflecting mirror used were manufactured by Fintech-Tokyo. The maximum output of the halogen lamp was $10\times10^3$ W/m, and the reflecting mirror used was an aluminum paraboloid mirror having a mirror-polished surface.

The conveyance speed of the transfer body was set to 0.4 m/s, and the output of the halogen lamp was adjusted such that the surface temperature of the transfer body after passing through the heating unit was 120° C.

Aurora Coat Paper (manufactured by Nippon Paper Industries Co., Ltd., basis weight: 104 g/m$^2$) was used as the printing medium 3108. The position of the pressing member 3106 was adjusted such that the pressure for pressing was 49 N/cm$^2$ (5 kgf/cm$^2$).

Examples 1 to 4 and Comparative Examples 1 and 2

Figure 23:
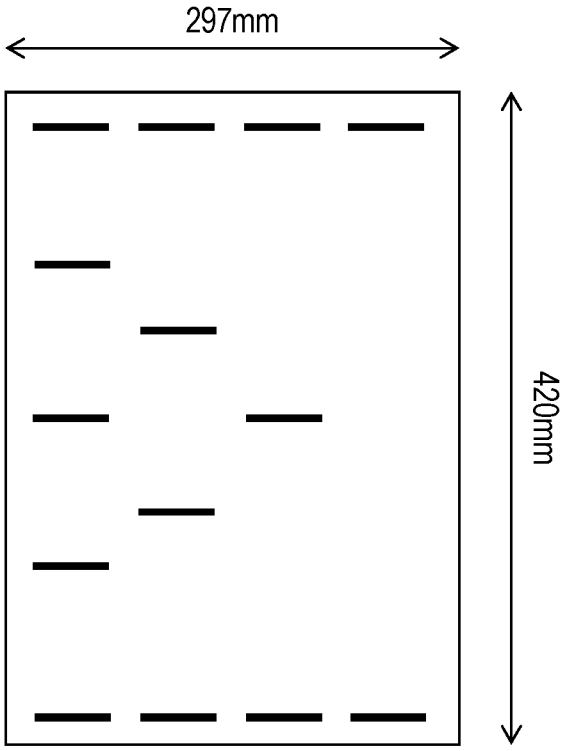
FIG. 23 is a diagram illustrating a printing pattern used in Examples.

In the ink jet printing apparatus illustrated in FIG. 1, after application of the reaction solution 1, the ink of Table 1 below was applied to the transfer body using the head of Table 1, and subjected to liquid absorption by the liquid absorbing member 3105*a* and heating by the heating apparatus 3010, followed by transfer to form a printing pattern. A pattern having ruled lines (width: 2 mm, length: 50 mm) as illustrated in FIG. 23 which were arranged at predetermined intervals was printed as the printing pattern. The continuous printing of 100 sheets was performed, and the disturbance of the printed patterns and the degree of dirt on the liquid absorbing member 3105*a* were visually evaluated.

Evaluation Criteria

A: The printed patterns were not disturbed on the 100 printed sheets, and dirt on the liquid absorbing member was not observed.

B: Dirt was slightly observed on the liquid absorbing member, though the printed patterns were not disturbed on the 100 printed sheets.

C: The printed patterns were partially disturbed on some of the 100 printed sheets, and dirt was observed on the liquid absorbing member.

The results are shown in Table 1.

TABLE 1

| | Head No. | J value | Circulation | Ink No. | Contact pressure of liquid absorbing member [N/cm$^2$] | Evaluation results |
|---|---|---|---|---|---|---|
| Example 1 | 1 | 1.52 | present | 1 | 9.8 | A |
| Example 2 | 2 | 1.75 | present | 1 | 9.8 | A |
| Example 3 | 2 | 1.75 | present | 2 | 9.8 | A |
| Example 4 | 2 | 1.75 | present | 2 | 19.6 | A |
| Comparative Example 1 | 1 | 1.52 | absent | 1 | 9.8 | B |
| Comparative Example 2 | 1 | 1.52 | absent | 2 | 9.8 | C |

Examples 5 to 7 and Comparative Examples 3 and 4

In Examples 5 to 7 and Comparative Examples 3 and 4, the pattern illustrated in FIG. 23 was printed using the liquid head and the ink given below without abutting the liquid absorbing member. The other conditions were the same as in Example 1.

The pattern (FIG. 23) printed using the configuration described above and the degree of ink image residues on the transfer body 3101 were visually evaluated for Examples 5 to 7 and Comparative Examples 3 and 4. The evaluation criteria were as described below.

Evaluation Criteria

A: The printed patterns were not disturbed on the 100 printed sheets, and there was no ink image residue on the transfer body.

B: A very small ink image residue was observed on the transfer body, though the printed patterns were not disturbed on the 100 printed sheets.

C: The printed patterns were partially disturbed on some of the 100 printed sheets, and ink image residues were observed on the transfer body.

The results are shown in Table 2.

TABLE 2

| | Head No. | J value | Circulation | Ink No. | Evaluation results |
|---|---|---|---|---|---|
| Example 5 | 1 | 1.52 | present | 1 | B |
| Example 6 | 2 | 1.75 | present | 1 | A |
| Example 7 | 2 | 1.75 | present | 2 | B |
| Comparative Example 3 | 1 | 1.52 | absent | 1 | C |
| Comparative Example 4 | 1 | 1.52 | absent | 2 | C |

According to the present invention, elevation in the proportion of the solvent due to the evaporation of water can be suppressed by circulating ink in the vicinity of the ejection orifice (pressure chamber) of the liquid ejection head. This permits stable image printing because an ink image in a stable agglomerated state is formed on the discharge receiving medium such as the transfer body.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-131279, filed Jul. 4, 2017, which is hereby incorporated by reference herein in its entirety.

What is claimed is:

1. An ink jet printing apparatus comprising:

an ink container containing an ink comprising water, a water-soluble organic solvent, a coloring material, and a resin component, wherein a content of the water-soluble organic solvent in the ink is 3.0% by mass or more to 50.0% by mass or less with respect to a total mass of the ink;

an image forming unit including (1) a reaction solution applying unit which applies a reaction solution containing a reactive component for ink thickening to a discharge receiving medium, and (2) an ejection head comprising a plurality of printing element substrates each including (a) an element which generates energy that is utilized for discharging the ink, (b) a flow path corresponding to a pressure chamber which has the element in the inside, (c) an ejection orifice, corresponding to the element, through which the ink is discharged to the discharge receiving medium, (d) an ejection orifice site which communicates the ejection orifice with the flow path corresponding to the pressure chamber, (e) a supply flow path which allows ink to flow into the flow path corresponding to the pressure chamber from the outside, and (f) an outflow path which allows ink to flow out of the flow path corresponding to the pressure chamber to the outside, wherein the supply flow path and the outflow path are communicated with the pressure chamber and are disposed within the ejection head, and wherein the following expression (1) is satisfied:

$$H^{-0.34}\times P^{-0.66}\times W>1.5 \quad (1),$$

wherein

H represents the upstream height of the flow path corresponding to the pressure chamber in the ink flow direction within the flow path corresponding to the pressure chamber, of a communicating unit between the flow path corresponding to the pressure chamber and the ejection orifice site, P represents the length of the ejection orifice site in the ink ejection direction from the ejection orifice, and W represents the length of the ejection orifice site in the ink flow direction within the flow path corresponding to the pressure chamber;

a liquid absorbing unit for absorbing at least a portion of a liquid component from an ink image formed by the ink by bringing a porous body into contact with the ink image, the liquid absorbing unit comprising a liquid absorbing member having the porous body; and a circulation unit which circulates the ink between the inside of the pressure chamber and the outside of the pressure chamber such that ink supplied through the supply flow path leaves from the pressure chamber to the outside of the pressure chamber through the outflow path, wherein the circulation unit performs ink circulation at least during the application of the ink to the discharge receiving medium.

2. The ink jet printing apparatus according to claim 1, wherein the following expression (2) is satisfied:

$$H^{-0.34}\times P^{-0.66}\times W>>1.7 \quad (2).$$

3. The ink jet printing apparatus according to claim 1, wherein the total mass of an aqueous liquid medium contained in the ink is 1 or more when the total mass of the coloring material and the resin component contained in the ink is defined as 1.

4. The ink jet printing apparatus according to claim 1, wherein, when the ink jet printing apparatus further comprises a transfer body, the contact pressure of the liquid absorbing member for the transfer body is 9.8 N/cm$^2$ or more.

5. The ink jet printing apparatus according to claim 1, wherein, when the ink jet printing apparatus further comprises a transfer body, the contact pressure of the liquid absorbing member for the transfer body is 19.6 N/cm$^2$ or more.

6. The ink jet printing apparatus according to claim 1, wherein the circulation unit controls ink circulation such that a change in the concentration of solid matter of the coloring material and the resin component contained in the ink is 1.2 or less times an initial value.

7. The ink jet printing apparatus according to claim 1, further comprising (1) a transfer body which serves as the discharge receiving medium, and (2) a transfer unit which transfers an ink image on the transfer body after treatment with the liquid absorbing member to a printing medium.

8. The ink jet printing apparatus according to claim 1, wherein the liquid absorbing unit concentrates the ink forming the ink image by bringing the porous body into contact with the ink image formed by the image forming unit and thereby absorbing at least a portion of a liquid component from the ink image.

9. An ink jet printing apparatus comprising:

a transfer body;

an ink container containing an ink comprising water, a water-soluble organic solvent, a coloring material, and a resin component, wherein a content of the water-soluble organic solvent in the ink is 3.0% by mass or more to 50.0% by mass or less with respect to a total mass of the ink;

an image forming unit including (1) a reaction solution applying unit which applies a reaction solution containing a reactive component for ink thickening to the transfer body, and (2) an ejection head comprising a plurality of printing element substrates each including (a) an element which generates energy that is utilized for discharging the ink, (b) a flow path corresponding to a pressure chamber which has the element in the inside, (c) an ejection orifice, corresponding to the element, through which the ink is discharged to the transfer body, (d) an ejection orifice site which communicates the ejection orifice with the flow path corresponding to the pressure chamber, (e) a supply flow path which allows ink to flow into the flow path corresponding to the pressure chamber from the outside, and (f) an outflow path which allows ink to flow out of the flow path corresponding to the pressure chamber to the outside, wherein the supply flow path and the outflow path are communicated with the pressure chamber and are disposed within the ejection head, and wherein the following expression (1) is satisfied:

$$H^{-0.34}\times P^{-0.66}\times W>1.5 \quad (1),$$

wherein

H represents the upstream height of the flow path corresponding to the pressure chamber in the ink flow direction within the flow path corresponding to the pressure chamber, of a communicating unit between the flow path corresponding to the pressure chamber and the ejection orifice site, P represents the length of the ejection orifice site in the ink ejection direction from the ejection orifice, and W represents the length of the ejection orifice site in the ink flow direction within the flow path corresponding to the pressure chamber;

a transfer unit which transfers an ink image formed by the ink to a printing medium; and a circulation unit which circulates the ink between the inside of the pressure chamber and the outside of the pressure chamber such that ink supplied through the supply flow path leaves from the pressure chamber to the outside of the pressure chamber through the outflow path, wherein the circulation unit performs ink circulation at least during the application of the ink to the transfer body.

10. The ink jet printing apparatus according to claim 9, further comprising a heating apparatus which heats the transfer body.

11. An ink jet printing method comprising:

forming an ink image containing an aqueous liquid component and a coloring material on a discharge receiving medium, the image formation comprising (1) applying a reaction solution containing a reactive component for ink thickening to the discharge receiving medium, and (2) applying ink comprising water, a water-soluble organic solvent, a coloring material, and a resin component, wherein a content of the water-soluble organic solvent in the ink is 3.0% by mass or more to 50.0% by mass or less with respect to total mass of the ink, to the discharge receiving medium using an ejection head comprising a plurality of printing element substrates each including (a) an element which generates energy that is utilized for discharging the ink, (b) a flow path corresponding to a pressure chamber which has the element in the inside, (c) an ejection orifice, corresponding to the element, through which the ink is discharged to a discharge receiving medium, (d) an ejection orifice site which communicates the ejection orifice with the flow path corresponding to the pressure chamber, (e) a supply flow path which allows ink to flow into the flow path corresponding to the pressure chamber from the outside, and (f) an outflow path both of which allows ink to flow out of the flow path corresponding to the pressure chamber to the outside, wherein the supply flow path and the outflow path are communicated with the pressure chamber and are disposed within the ejection head, and wherein the following expression (1) is satisfied:

$$H^{-0.34} \times P^{-0.66} \times W > 1.5 \quad (1),$$

wherein

H represents the upstream height of the flow path corresponding to the pressure chamber in the ink flow direction within the flow path corresponding to the pressure chamber, of a communicating unit between the flow path corresponding to the pressure chamber and the ejection orifice site, P represents the length of the ejection orifice site in the ink ejection direction from the ejection orifice, and W represents the length of the ejection orifice site in the ink flow direction within the flow path corresponding to the pressure chamber; and absorbing at least a portion of a liquid component from the ink image formed by the ink by bringing a liquid absorbing member having a porous body into contact with the ink image, wherein the ink is circulated between the inside of the pressure chamber and the outside of the pressure chamber such that ink supplied through the supply flow path leaves from the pressure chamber to the outside of the pressure chamber through the outflow path, and wherein the ink circulation is performed at least during the application of the ink to the discharge receiving medium.

12. The ink jet printing method according to claim 11, wherein the discharge receiving medium is a transfer body which transiently retains the ink image, and the ink jet printing method further comprises transferring the ink image on the transfer body to a printing medium after the liquid absorption.

13. An ink jet printing method comprising:

forming an ink image containing an aqueous liquid component and a coloring material on a transfer body, the image formation comprising (1) applying a reaction solution containing a reactive component for ink thickening to the transfer body, and (2) applying ink comprising water, a water-soluble organic solvent, a coloring material, and a resin component, wherein a content of the water-soluble organic solvent in the ink is 3.0% by mass or more to 50.0% by mass or less with respect to a total mass of the ink, to the transfer body using an ejection head comprising a plurality of printing element substrates each including (a) an element which generates energy that is utilized for discharging the ink, (b) a flow path corresponding to a pressure chamber which has the element in the inside, (c) an ejection orifice, corresponding to the element, through which the ink is discharged to the transfer body, (d) an ejection orifice site which communicates the ejection orifice with the flow path corresponding to the pressure chamber, (e) a supply flow path which allows ink to flow into the flow path corresponding to the pressure chamber from the outside, and (f) an outflow path which allows ink to flow out of the flow path corresponding to the pressure chamber to the outside, wherein the supply flow path and the outflow path are communicated with the pressure chamber and are disposed within the ejection head, and wherein the following expression (1) is satisfied:

$$H^{-0.34} \times P^{-0.66} \times W > 1.5 \quad (1),$$

wherein

H represents the upstream height of the flow path corresponding to a pressure chamber in the ink flow direction within the flow path corresponding to a pressure chamber, of a communicating unit between the flow path corresponding to a pressure chamber and the ejection orifice site, P represents the length of the ejection orifice site in the ink ejection direction from the ejection orifice, and W represents the length of the ejection orifice site in the ink flow direction within the flow path corresponding to a pressure chamber; and transferring the ink image to a printing medium, wherein the ink is circulated between the inside of the pressure chamber and the outside of the pressure chamber such that ink supplied through the supply flow path leaves from the pressure chamber to the outside of the pressure chamber through the outflow path, and wherein the ink circulation is performed at least during the application of the ink to the transfer body.

* * * * *